US009135921B2

(12) United States Patent
Kishi et al.

(10) Patent No.: US 9,135,921 B2
(45) Date of Patent: Sep. 15, 2015

(54) AUDIO CODING DEVICE AND METHOD

(71) Applicant: FUJITSU LIMITED, Kawasaki-shi, Kanagawa (JP)

(72) Inventors: Yohei Kishi, Kawasaki (JP); Miyuki Shirakawa, Fukuoka (JP); Shunsuke Takeuchi, Kawasaki (JP); Masanao Suzuki, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 347 days.

(21) Appl. No.: 13/713,487

(22) Filed: Dec. 13, 2012

(65) Prior Publication Data

US 2013/0182854 A1 Jul. 18, 2013

(30) Foreign Application Priority Data

Jan. 18, 2012 (JP) ..... 2012-008484

(51) Int. Cl.

| | |
|---|---|
| ***H04R 5/00*** | (2006.01) |
| ***G10L 19/008*** | (2013.01) |
| *G10L 19/00* | (2013.01) |
| *G10L 19/02* | (2013.01) |
| *G10L 25/12* | (2013.01) |

(52) U.S. Cl.

CPC ..... *G10L 19/008* (2013.01); *G10L 19/0204* (2013.01); *G10L 19/0212* (2013.01); *G10L 25/12* (2013.01); *G10L 2019/0001* (2013.01)

(58) Field of Classification Search

None

See application file for complete search history.

(56) References Cited

U.S. PATENT DOCUMENTS 6,360,200 B1 * 3/2002 Edler et al. ..... 704/219
2006/0140412 A1 6/2006 Villemoes et al.

(Continued)

FOREIGN PATENT DOCUMENTS

EP 1 132 891 A1 9/2001
JP 2008-517338 5/2008

(Continued)

OTHER PUBLICATIONS

"Information technology—MPEG audio technologies—Part 1: MPEG Surround", International Standard ISO/IEC 23003-1, Feb. 2, 2007, 57 pages.

(Continued)

*Primary Examiner* — Andrew L Sniezek

(74) *Attorney, Agent, or Firm* — Oblon, McClelland, Maier & Neustadt, L.L.P.

(57) ABSTRACT

An audio coding device that uses a first-channel signal, a second-channel signal, and a plurality of channel prediction coefficients included in a code book, according to which predictive coding is performed on a third-channel signal, the first-channel signal, the second-channel signal, and the third-channel signal being included in a plurality of channels of an audio signal, the device includes, a processor; and a memory which stores a plurality of instructions, which when executed by the processor, cause the processor to execute, determining a distribution of error defined by a difference between the third-channel signal before predictive coding and the third-channel signal after predictive coding as a given curved surface according to the first-channel signal, the second-channel signal, and the third-channel signal before predictive coding; and calculating channel prediction coefficients, included in the code book.

15 Claims, 15 Drawing Sheets

(56) References Cited

U.S. PATENT DOCUMENTS

| | | | | |
|---|---|---|---|---|
| 2006/0165237 | A1 | 7/2006 | Villemoes et al. | |
| 2008/0219344 | A1 | 9/2008 | Suzuki et al. | |
| 2014/0050324 | A1* | 2/2014 | Kamano et al. | 381/23 |
| 2014/0236603 | A1* | 8/2014 | Takeuchi et al. | 704/500 |

FOREIGN PATENT DOCUMENTS

| | | | |
|---|---|---|---|
| JP | 2008-224902 | | 9/2008 |
| WO | WO 2006/048203 | A1 | 5/2006 |

OTHER PUBLICATIONS

Extended European Search Report issued Feb. 24, 2014 in Patent Application No. 12198522.0.

Gerard Hotho, et al., "A Backward-Compatible Multichannel Audio Codec", IEEE Transactions on Audio, Speech, and Language Processing, vol. 16, No. 1, Jan. 2008, pp. 83-93.

Robert M Gray, et al., "Quantization", IEEE Transactions on Information Theory, vol. 44, No. 6, Oct. 1998, pp. 2325-2383.

Zhibin Pan, et al., "Fast Encoding Method for Image Vector Quantization Based on Multiple Appropriate Features to Estimate Euclidean Distance", Optical Review, vol. 12, No. 3, 2005, pp. 161-169.

* cited by examiner

FIG. 2

| idx | 0 | 1 | 2 | 3 | 4 | 5 | 6 | 7 |
|---|---|---|---|---|---|---|---|---|
| ICC[idx] | 1 | 0.937 | 0.84118 | 0.60092 | 0.36764 | 0 | -0.589 | -0.99 |

210

220

200

FIG. 3

| DIFFERENCE | idxicci |
|---|---|
| -7 | 11111111111111 |
| -6 | 11111111111110 |
| -5 | 111111111110 |
| -4 | 1111111110 |
| -3 | 1111110 |
| -2 | 11110 |
| -1 | 110 |
| 0 | 0 |

| DIFFERENCE | idxicci |
|---|---|
| 1 | 10 |
| 2 | 1110 |
| 3 | 111110 |
| 4 | 11111110 |
| 5 | 111111110 |
| 6 | 11111111110 |
| 7 | 1111111111110 |

300

FIG. 4

| | | | | | | | | | | | | |
|---|---|---|---|---|---|---|---|---|---|---|---|---|
| Idx | -15 | -14 | -13 | -12 | -11 | -10 | -9 | -8 | -7 | -6 | -5 | 410 |
| CLD[idx] | -150 | -45 | -40 | -35 | -30 | -25 | -22 | -19 | -16 | -13 | -10 | 420 |
| Idx | -4 | -3 | -2 | -1 | 0 | 1 | 2 | 3 | 4 | 5 | 6 | 430 |
| CLD[idx] | -8 | -6 | -4 | -2 | 0 | 2 | 4 | 6 | 8 | 10 | 13 | 440 |
| Idx | 7 | 8 | 9 | 10 | 11 | 12 | 13 | 14 | 15 | 450 | | |
| CLD[idx] | 16 | 19 | 22 | 25 | 30 | 35 | 40 | 45 | 150 | 460 | | |

400

FIG. 11

| | | | | | | | | | | | | |
|---|---|---|---|---|---|---|---|---|---|---|---|---|
| idx | -20 | -19 | -18 | -17 | -16 | -15 | -14 | -13 | -12 | -11 | -10 | |
| c [idx] | -2.0 | -1.9 | -1.8 | -1.7 | -1.6 | -1.5 | -1.4 | -1.3 | -1.2 | -1.1 | -1.0 | 1110 |
| idx | -9 | -8 | -7 | -6 | -5 | -4 | -3 | -2 | -1 | 0 | 1 | 1115 |
| c [idx] | -0.9 | -0.8 | -0.7 | -0.6 | -0.5 | -0.4 | -0.3 | -0.2 | -0.1 | 0.0 | 0.1 | 1120 |
| idx | 2 | 3 | 4 | 5 | 6 | 7 | 8 | 9 | 10 | 11 | 12 | 1125 |
| c [idx] | 0.2 | 0.3 | 0.4 | 0.5 | 0.6 | 0.7 | 0.8 | 0.9 | 1.0 | 1.1 | 1.2 | 1130 |
| idx | 13 | 14 | 15 | 16 | 17 | 18 | 19 | 20 | 21 | 22 | 23 | 1135 |
| c [idx] | 1.3 | 1.4 | 1.5 | 1.6 | 1.7 | 1.8 | 1.9 | 2.0 | 2.1 | 2.2 | 2.3 | 1140 |
| idx | 24 | 25 | 26 | 27 | 28 | 29 | 30 | | | | | 1145 |
| c [idx] | 2.4 | 2.5 | 2.6 | 2.7 | 2.8 | 2.9 | 3.0 | | | | | |

1150

1155

1100

AUDIO CODING DEVICE AND METHOD

CROSS-REFERENCE TO RELATED APPLICATION(S)

This application is based upon and claims the benefit of priority of the prior Japanese Patent Application No. 2012-008484, filed on Jan. 18, 2012, the entire contents of which are incorporated herein by reference.

FIELD

The embodiments discussed herein are related to, for example, an audio coding device, an audio coding method, and a computer-readable recoding medium that stores an audio coding computer program.

BACKGROUND

To reduce the amount of data of a multi-channel audio signal with three or more channels, methods of coding an audio signal have been developed. Of these, one coding method standardized by the Moving Picture Experts Group (MPEG) is known as the MPEG Surround method. In the MPEG Surround method, a 5.1-channel audio signal to be coded undergoes time-frequency conversion and the frequency signal resulting from the time-frequency conversion is down-mixed, creating a three-channel frequency signal. When the three-channel frequency signal is down-mixed again, a frequency signal corresponding to a two-channel stereo signal is calculated. The frequency signal corresponding to the stereo signal is coded by the Advanced Audio Coding (AAC) method and Spectral Band Replication (SBR) method. In the MPEG Surround method, spatial information, which indicates spread or localization of sound is calculated at the time when the 5.1-channel signal is down-mixed to the three-channel signal and when the three-channel signal is down-mixed to the two-channel signal, after which the spatial information is coded. Accordingly, in the MPEG Surround method, a stereo signal resulting from down-mixing a multi-channel audio signal and spatial signal with a relatively small amount of data are coded. Therefore, the MPEG Surround method achieves higher compression efficiency than when a signal in each channel included in a multi-channel audio signal is independently coded.

In the MPEG Surround method, spatial information calculated at the creation of a stereo frequency signal is coded by using channel prediction coefficients. The channel prediction coefficients are used to perform predictive coding on a signal in one of three channels according to signals in the remaining two channels. A plurality of channel prediction coefficients are stored in a table, which is a so-called coding book. The coding book is used to improve the efficiency of the bit rate in use. When a coder and a decoder share a common predetermined coding book (or they each have a coding book created by a common method), it becomes possible to transmit more important information with less bits. At the time of decoding, the signal in one of the three channels is replicated according to the channel prediction coefficient described above. Therefore, it is desirable to select an optimum channel prediction coefficient from the code book at the time of coding.

In an disclosed method of selecting an optimum channel prediction coefficient from the code book, error defined by a difference between a channel signal before predictive coding and a channel signal resulting from the predictive coding is calculated by using each of all channel prediction coefficients stored in the code book, and a channel prediction coefficient that minimizes the error in predictive coding is selected. A technology to calculate a channel prediction coefficient that minimizes error by using the least squares method is also disclosed in Japanese Laid-open Patent Publication No. 2008-517338.

SUMMARY

According to an aspect of the embodiment, an audio coding device that uses a first-channel signal, a second-channel signal, and a plurality of channel prediction coefficients included in a code book, according to which predictive coding is performed on a third-channel signal, the first-channel signal, the second-channel signal, and the third-channel signal being included in a plurality of channels of an audio signal, the device includes, a processor; and a memory which stores a plurality of instructions, which when executed by the processor, cause the processor to execute, determining a distribution of error defined by a difference between the third-channel signal before predictive coding and the third-channel signal after predictive coding as a given curved surface according to the first-channel signal, the second-channel signal, and the third-channel signal before predictive coding; and calculating channel prediction coefficients, included in the code book, that correspond to the first channel and the second channel from the code book, according to a minimum value of the error, the minimum value being defined by the given curved surface, and to a code book range defined by a minimum channel prediction coefficient and a maximum channel prediction coefficient among the plurality of channel prediction coefficients.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 2 illustrates an example of a quantization table of similarity;

FIG. 3 illustrates an example of a table that indicates relationships between inter-index differences and similarity codes;

FIG. 4 illustrates an example of a quantization table of differences in strength;

Figure 9A:
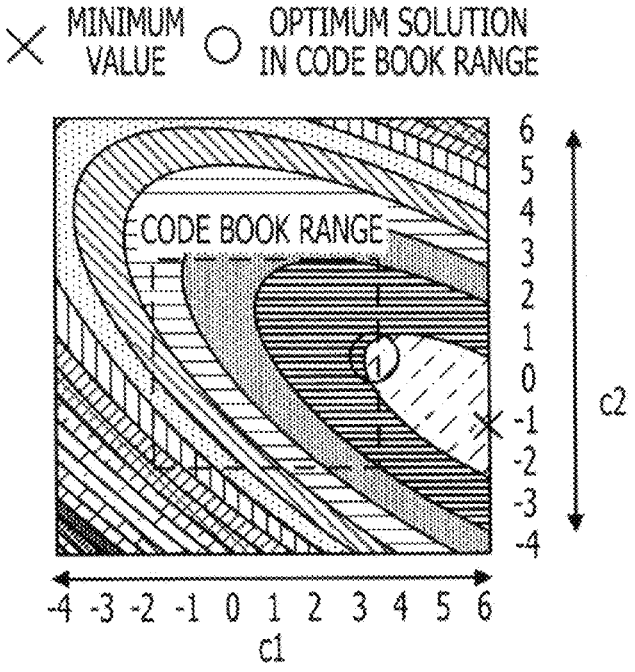
Figure 9B:
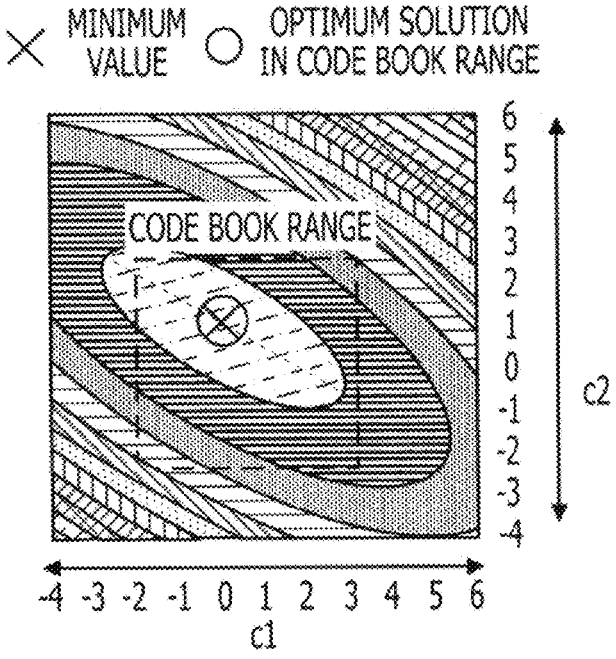
Figure 10:
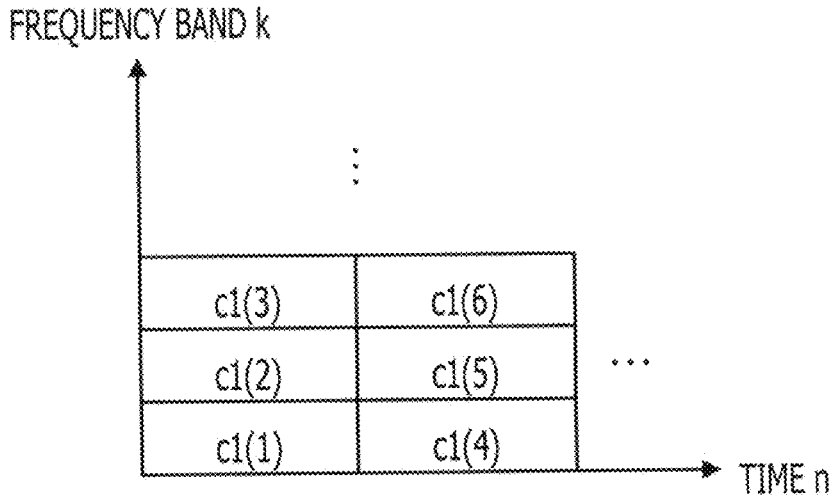
Figure 12:
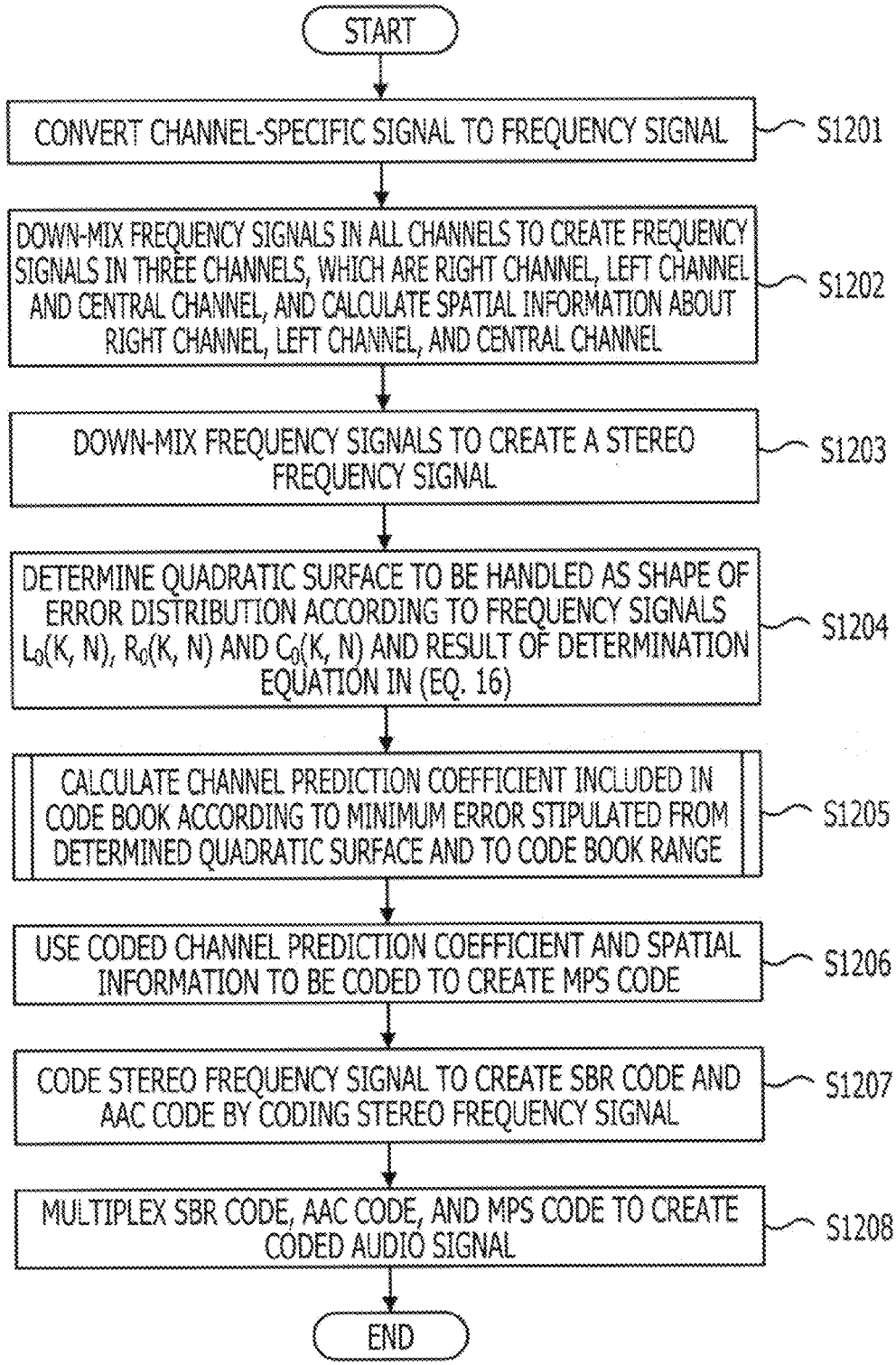
Figure 13:
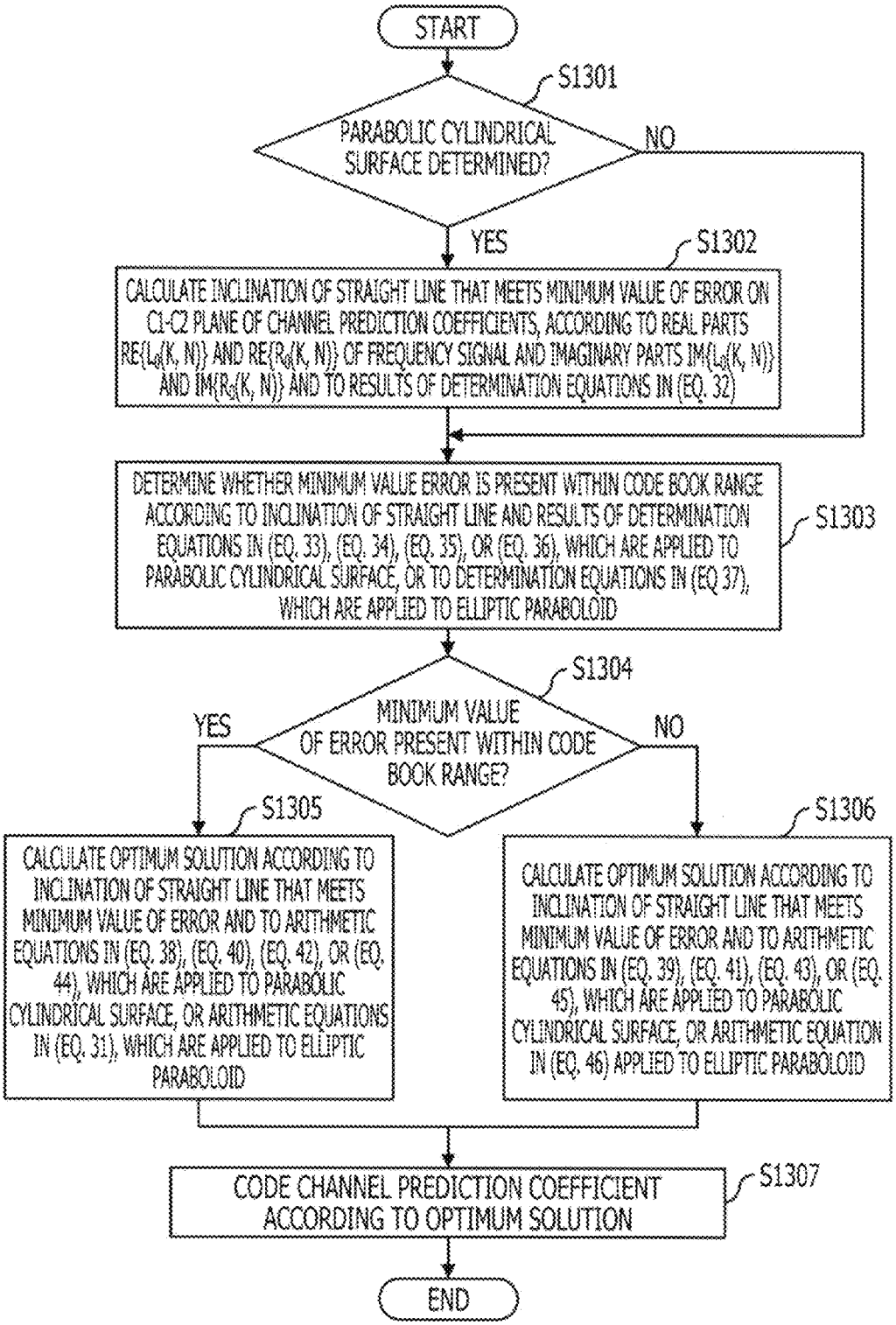
Figure 14A:
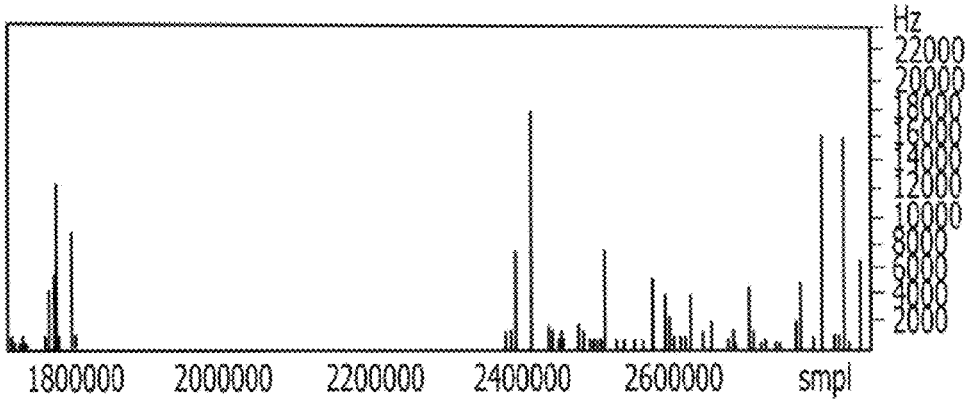
Figure 14B:
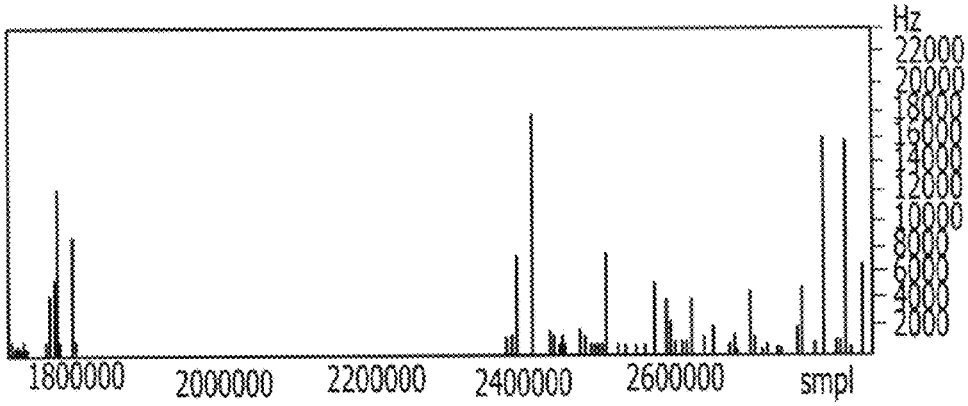
Figure 14C:
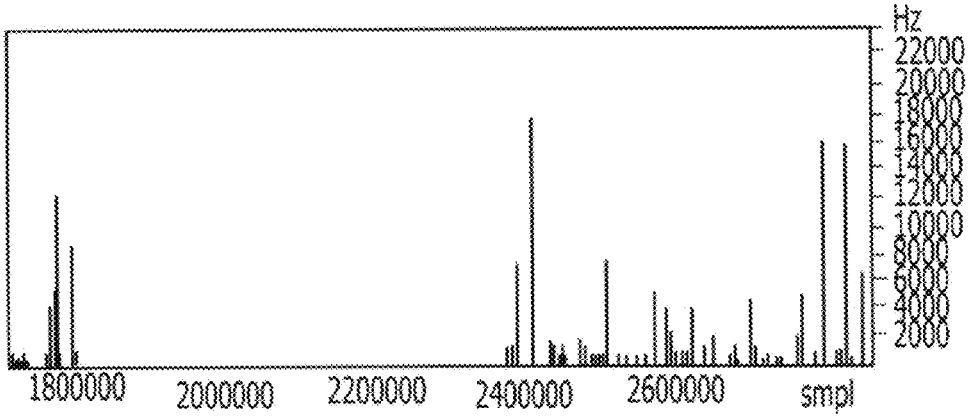
Figure 15:
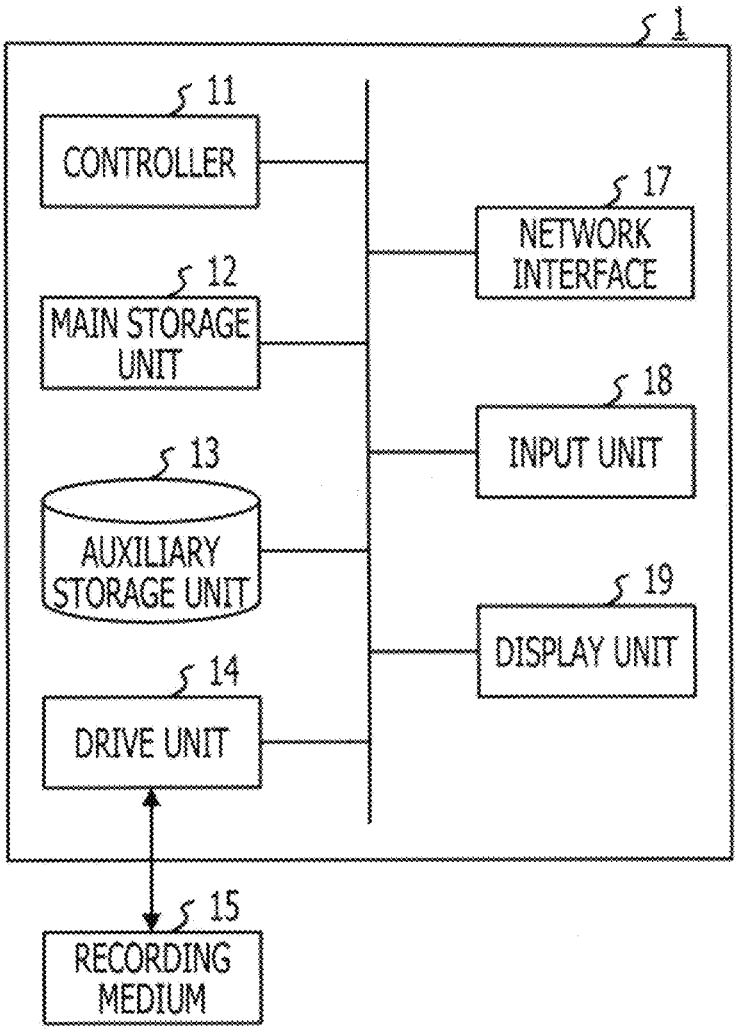

8B is a conceptual diagram illustrating an optimum solution in a case in which the minimum value on the parabolic cylindrical surface in the c1-c2 plane of channel prediction coefficients is present outside the code book range;

FIG. 9A is a conceptual diagram illustrating an optimum solution in a case in which the minimum value on the elliptic paraboloid in the c1-c2 plane of channel prediction coefficients is present within the code book range, and FIG. 9B is a conceptual diagram illustrating the optimum solution in a case in which the minimum value on the elliptic paraboloid in the c1-c2 plane of channel prediction coefficients is present outside the code book range;

FIG. 10 is a conceptual diagram illustrating the band of a channel prediction coefficient for each combination of time and a frequency band;

FIG. 11 illustrates an example of a quantization table of channel prediction coefficients;

FIG. 12 is an operation flowchart in audio coding processing;

FIG. 13 is an operation flowchart in channel prediction coefficient selection processing;

FIG. 14A is a spectral diagram of the original sound of a multi-channel audio signal, FIG. 14B is a comparative example of a spectral diagram of an audio signal obtained by searching for all channel prediction coefficients included in the code book, followed by coding and decoding, and FIG. 14C is a spectra diagram of an audio signal obtained by using the channel prediction coefficient selection method in the present disclosure to code a channel prediction coefficient and then decoding the coded channel prediction coefficient; and FIG. 15 is a functional block diagram of an audio coding device according to another embodiment.

DESCRIPTION OF EMBODIMENTS

An audio coding device, an audio coding method, and a computer-readable recoding medium that stores an audio coding computer program according to an embodiment will be described in detail with reference to the drawings. This embodiment does not restrict the disclosed technology.

Figure 1:
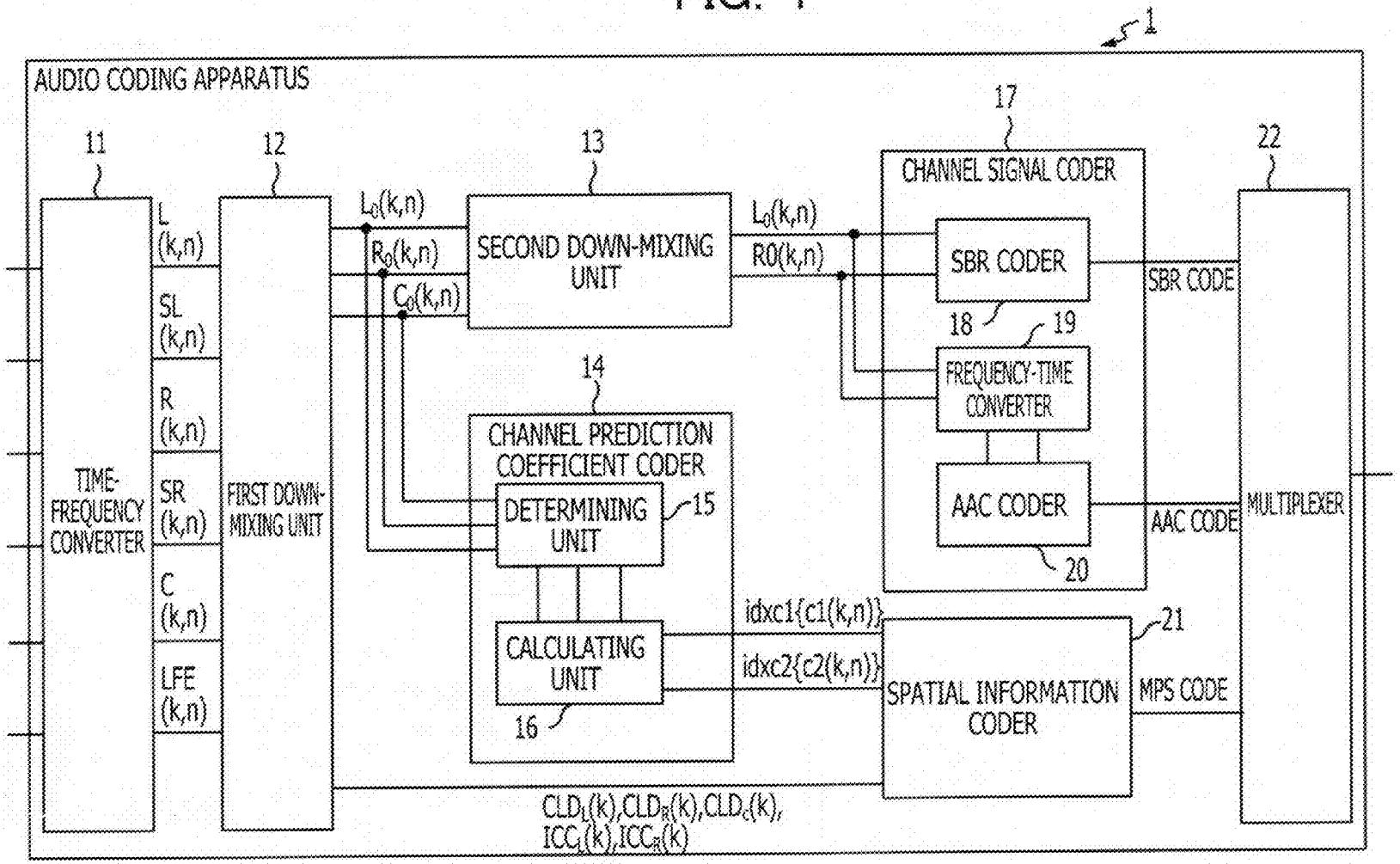
FIG. 1 is a functional block diagram of an audio coding device according to an embodiment.

FIG. 1 is a functional block diagram of an audio coding device 1 according to an embodiment. As illustrated in FIG. 1, the audio coding device 1 includes a time-frequency converter 11, a first down-mixing unit 12, a second down-mixing unit 13, a channel prediction coefficient coder 14, a channel signal coder 17, a spatial information coder 21, and a multiplexer 22. The channel prediction coefficient coder 14 includes a determining unit 15 and a calculating unit 16. The channel signal coder 17 includes an SBR coder 18, a frequency-time converter 19, and an AAC coder 20.

These components of the audio coding device 1 are each formed as an individual circuit. Alternatively, these components of the audio coding device 1 may be installed into the audio coding device 1 as a single integrated circuit in which the circuits corresponding to these components are integrated. In addition, these components of the audio coding device 1 may be each a functional module that is implemented by a computer program executed by a processor included in the audio coding device 1.

The time-frequency converter 11 performs time-frequency conversion, one frame at a time, on a channel-specific signal in the time domain of a multi-channel audio signal entered into the audio coding device 1 so that the signal is converted to a frequency signal in the channel. In this embodiment, the time-frequency converter 11 uses a quadrature mirror filter (QMF) bank to convert a channel-specific signal to a frequency signal.

$$QMF(k, n) = \exp\left[j\frac{\pi}{128}(k+0.5)(2n+1)\right], \quad 0 \le k < 64,\ 0 \le n < 128 \qquad \text{(Eq. 1)}$$

where n is a variable indicating time and k is a variable indicating a frequency band. The variable n indicates time in the nth time when an audio signal for one frame is equally divided into 128 segments in the time direction. The frame length may take any value in the range of, for example, 10 ms to 80 ms. The variable k indicates the kth frequency band when the frequency band of the frequency signal is equally divided into 64 segments. QMF(k, n) is a QMF used to output a frequency signal with frequency k at time n. The time-frequency converter 11 multiplies a one-frame audio signal in an entered channel by QMF(k, n) to create a frequency signal in the channel. The time-frequency converter 11 may use fast Fourier transform, discrete cosine transform, modified discrete cosine transform, or another type of time-frequency conversion processing to convert a channel-specific signal to a frequency signal.

Each time the time-frequency converter 11 calculates a channel-specific frequency signal one frame at a time, the time-frequency converter 11 outputs the channel-specific frequency signal to the first down-mixing unit 12.

Each time the first down-mixing unit 12 receives the frequency signals in all channels, the first down-mixing unit 12 down-mixes the frequency signals in these channels to create frequency signals in a left channel, central channel, and right channel. For example, the first down-mixing unit 12 calculates frequency signals in these three channels according to the equations below.

$$L_{in}(k,n)=L_{in_{Re}}(k,n)+j\cdot L_{inIm}(k,n)\ 0\le k<64, 0\le n<128$$

$$L_{inRe}(k,n)=L_{in_{Re}}(k,n)+SL_{Re}(k,n)$$

$$L_{inIm}(k,n)=L_{Im}(k,n)+SL_{Im}(k,n)$$

$$R_{in}(k,n)=R_{in_{Re}}(k,n)+j\cdot R_{inIm}(k,n)$$

$$R_{inRe}(k,n)=R_{Re}(k,n)+SR_{Re}(k,n)$$

$$R_{inIm}(k,n)=R_{Im}(k,n)+SR_{Im}(k,n)$$

$$C_{in}(k,n)=C_{in_{Re}}(k,n)+j\cdot C_{inIm}(k,n)$$

$$C_{inRe}(k,n)=C_{Re}(k,n)+LFE_{Re}(k,n)$$

$$C_{inIm}(k,n)=C_{Im}(k,n)+LFE_{Im}(k,n) \qquad \text{(Eq. 2)}$$

$L_{Re}(k, n)$ indicates the real part of front-left-channel frequency signal L(k, n), and $L_{Im}(k, n)$ indicates the imaginary part of front-left-channel frequency signal L(k, n). $SL_{Re}(k, n)$ indicates the real part of rear-left-channel frequency signal SL(k, n), and $SL_{Im}(k, n)$ indicates the imaginary part of rear-left-channel frequency signal SL(k, n). $L_{in}(k, n)$ indicates a left-channel frequency signal resulting from down-mixing. $L_{inRe}(k, n)$ indicates the real part of the left-channel frequency signal, and $L_{inIm}(k, n)$ indicates the imaginary part of the left-channel frequency signal.

Similarly, $R_{Re}(k, n)$ indicates the real part of front-right-channel frequency signal R(k, n), and $R_{Im}(k, n)$ indicates the imaginary part of front-right-channel frequency signal R(k, n). $SR_{Re}(k, n)$ indicates the real part of rear-right-channel frequency signal SR(k, n), and $SR_{Im}$(k, n) indicates the imaginary part of rear-right-channel frequency signal SR(k, n). $R_{in}$(k, n) indicates a right-channel frequency signal resulting from down-mixing. $R_{inRe}$(k, n) indicates the real part of the right-channel frequency signal, and $R_{inIm}$(k, n) indicates the imaginary part of the right-channel frequency signal.

Similarly again, $C_{Re}$(k, n) indicates the real part of central-channel frequency signal C(k, n), and $C_{Im}$(k, n) indicates the imaginary part of central-channel frequency signal C(k, n). $LFE_{Re}$(k, n) indicates the real part of deep-bass-channel frequency signal LFE(k, n), and $LFE_{Im}$(k, n) indicates the imaginary part of deep-bass-channel frequency signal LFE(k, n). $C_{in}$(k, n) indicates a central-channel frequency signal resulting from down-mixing. $C_{inRe}$(k, n) indicates the real part of central-channel frequency signal $C_{in}$(k, n), and $C_{inIm}$(k, n) indicates the imaginary part of central-channel frequency signal $C_{in}$(k, n).

The first down-mixing unit 12 also calculates, for each frequency band, a difference in strength between frequency signals in two channels to be down-mixed, which indicates localization of sound, and similarity between these frequency signals, which indicates spread of sound, as spatial information of these frequency signals. The spatial information calculated by the first down-mixing unit 12 is an example of three-channel spatial information. In this embodiment, the first down-mixing unit 12 calculates, for the left channel, a difference in strength $CLD_L$(k) and similarity $ICC_L$(k) in frequency band k, according to the equations below.

$$CLD_L(k) = 10\log_{10}\left(\frac{e_L(k)}{e_{SL}(k)}\right) \quad \text{(Eq. 3)}$$

$$ICC_L(k) = Re\left\{\frac{e_{LSL}(k)}{\sqrt{e_L(k)\cdot e_{SL}(k)}}\right\}$$

$$e_L(k) = \sum_{n=0}^{N-1} |L(k, n)|^2 \quad \text{(Eq. 4)}$$

$$e_{SL}(k) = \sum_{n=0}^{N-1} |SL(k, n)|^2$$

$$e_{LSL}(k) = \sum_{n=0}^{N-1} L(k, n)\cdot SL(k, n)$$

In Eq. 4, N indicates the number of samples included in one frame in the time direction, N being 128 in this embodiment; $e_L$(k) is an auto-correlation value of front-left-channel frequency signal L(k, n); $e_{SL}$(k) is an auto-correlation value of rear-left-channel frequency signal SL(k, n); $e_{LSL}$(k) is a cross-correlation value between front-left-channel frequency signal L(k, n) and rear-left-channel frequency signal SL(k, n).

Similarly, the first down-mixing unit 12 calculates, for the right channel, a difference in strength $CLD_R$(k) and similarity $ICC_R$(k) in frequency band k, according to the equations below.

$$CLD_R(k) = 10\log_{10}\left(\frac{e_R(k)}{e_{SR}(k)}\right) \quad \text{(Eq. 5)}$$

$$ICC_R(k) = Re\left\{\frac{e_{RSR}(k)}{\sqrt{e_R(k)\cdot e_{SR}(k)}}\right\}$$

-continued $$e_R(k) = \sum_{n=0}^{N-1} |R(k, n)|^2 \quad \text{(Eq. 6)}$$

$$e_{SR}(k) = \sum_{n=0}^{N-1} |SR(k, n)|^2$$

$$e_{RSR}(k) = \sum_{n=0}^{N-1} L(k, n)\cdot SR(k, n)$$

In Eq. 6, $e_R$(k) is an auto-correlation value of f front-right-channel fs R(k, n); $e_{SR}$(k) is an auto-correlation value of rear-right-channel frequency signal SR(k, n); $e_{RSR}$(k) is a cross-correlation value between front-right-channel frequency signal R(k, n) and rear-right-channel frequency signal SR(k, n).

Similarly again, the first down-mixing unit 12 calculates, for the central channel, a difference in strength $CLD_C$(k) in frequency band k, according to the equations below.

$$CLD_C(k) = 10\log_{10}\left(\frac{e_C(k)}{e_{LFE}(k)}\right) \quad \text{(Eq. 7)}$$

$$e_C(k) = \sum_{n=0}^{N-1} |C(k, n)|^2$$

$$e_{LFE}(k) = \sum_{n=0}^{N-1} |LFE(k, n)|^2$$

In Eq. 7, $e_C$(k) is an auto-correlation value of central-channel frequency signal C(k, n); $e_{LFE}$(k) is an auto-correlation value of deep-bass-channel frequency signal LFE(k, n).

Upon completion of the creation of the three-channel frequency signals, the first down-mixing unit 12 further down-mixes the left-channel frequency signal and central-channel frequency signal to create a left-side stereo frequency signal, and also down-mixes the right-channel frequency signal and central-channel frequency signal to create a right-side stereo frequency signal. For example, the first down-mixing unit 12 creates left-side stereo frequency signal $L_0$(k, n) and right-side stereo frequency signal $R_0$(k, n) according to the equation below. The first down-mixing unit 12 also calculates central-channel signal $C_0$(k, n), which is used to select a channel prediction coefficient included in the code book, according to the equation below.

$$\begin{pmatrix} L_0(k, n) \\ R_0(k, n) \\ C_0(k, n) \end{pmatrix} = \begin{pmatrix} 1 & 0 & \frac{\sqrt{2}}{2} \\ 0 & 1 & \frac{\sqrt{2}}{2} \\ 1 & 1 & -\frac{\sqrt{2}}{2} \end{pmatrix} \begin{pmatrix} L_{in}(k, n) \\ R_{in}(k, n) \\ C_{in}(k, n) \end{pmatrix} \quad \text{(Eq. 8)}$$

In Eq. 8, $L_{in}$(k, n), $R_{in}$(k, n), and $C_{in}$(k, n) are respectively the left-channel frequency signal, right-channel frequency signal, and central-channel frequency signal created by the first down-mixing unit 12. Left-side frequency signal $L_0$(k, n) is created by combining the front-left-channel, rear-left-channel, central-channel, and deep-bass-channel frequency signals of the original multi-channel audio signal. Similarly, right-side frequency signal $R_0$(k, n) is created by combining the front-right-channel, rear-right-channel, central-channel, and deep-bass-channel frequency signals of the original multi-channel audio signal.

The first down-mixing unit 12 outputs left-side frequency signal $L_0(k, n)$, right-side frequency signal $R_0(k, n)$, and central-channel frequency signal $C_0(k, n)$ to the second down-mixing unit 13 and channel prediction coefficient coder 14. The first down-mixing unit 12 also outputs differences in strength $CLD_L(k)$, $CLD_R(k)$ and $CLD_C(k)$ and similarities $ICC_L(k)$ and $ICC_R(k)$ to the spatial information coder 21.

The second down-mixing unit 13 receives the left-side frequency signal $L_0(k, n)$, right-side frequency signal $R_0(k, n)$, and central-channel frequency signal $C_0(k, n)$ from the first down-mixing unit 12 and down mixes two fffs of these three-channel frequency signals to create a two-channel stereo frequency signal. The second down-mixing unit 13 then outputs the created stereo frequency signal to the channel signal coder 17.

The channel prediction coefficient coder 14 selects channel prediction coefficients from the code book for the two-channel frequency signals to be down-mixed. Specifically, the channel prediction coefficient coder 14 selects, for each frequency band, channel prediction coefficients c1(k) and c2(k) that minimizes error d(k), defined by the first equation in Eq. 9 below, between the frequency signal before predictive coding and the frequency signal after predictive coding according to $C_0(k, n)$, $L_0(k, n)$, and $R_0(k, n)$.

$$d(k) = \sum_k \sum_n \{|c_0(k, n) - c1 \times l_0(k, n) - c2 \times r_0(k, n)|^2\} \quad \text{(Eq. 9)}$$

$$C'_0(k, n) = c_1(k) \cdot L_0(k, n) + c_2(k) \cdot R_0(k, n)$$

The channel prediction coefficient coder 14 handles the distribution of error d that is taken when a plurality of channel prediction coefficients included in the code book are used, as a quadratic surface. The channel prediction coefficient coder 14 also determines whether the minimum value defined by the quadratic surface is present within the code book range defined by the minimum channel prediction coefficient and maximum channel prediction coefficient included in the code book, and calculates channel prediction coefficients c1(k) and c2(k) included in the code book according to the determination result. Channel prediction coefficient calculation by the channel prediction coefficient coder 14 will be described later in detail.

The channel signal coder 17 receives the stereo frequency signal from the second down-mixing unit 13 and codes the received frequency signal. As described above, the channel signal coder 17 includes the SBR coder 18, frequency-time converter 19, and AAC coder 20.

Each time the SBR coder 18 receives a stereo frequency signal, the SBR coder 18 codes the high-frequency components, which are included in a high-frequency band, of the stereo frequency signal for each channel, according to the SBR coding method. Thus, the SBR coder 18 creates an SBR code. For example, the SBR coder 18 replicates the low-frequency components, which have a close correlation with the high-frequency components to be subject to SBR coding, of a channel-specific frequency signal, as disclosed in Japanese Laid-open Patent Publication No. 2008-224902. The low-frequency components are components of a channel-specific frequency signal included in a low-frequency band, the frequencies of which are lower than the high-frequency band in which the high-frequency components to be coded by the SBR coder 18 are included. The low-frequency components are coded by the AAC coder 20, which will be described later. The SBR coder 18 adjusts the electric power of the replicated high-frequency components so that the electric power matches the electric power of the original high-frequency components. The SBR coder 18 handles, as auxiliary information, original high-frequency components that make it fail to approximate high-frequency components even when low-frequency components are replicated because differences from low-frequency components are large. The SBR coder 18 performs coding by quantizing information that represents a positional relationship between the low-frequency components used in replication and their corresponding high-frequency components, an amount by which electric power has been adjusted, and the auxiliary information. The SBR coder 18 outputs the SBR code, which is the above coded information, to the multiplexer 22.

Each time the frequency-time converter 19 receives a stereo frequency signal, the frequency-time converter 19 converts a channel-specific stereo frequency signal to a stereo signal in the time domain. When, for example, the time-frequency converter 11 uses a QMF filter bank, the frequency-time converter 19 uses a complex QMF filter bank represented by the equation below to perform frequency-time conversion on the channel-specific stereo frequency signal.

$$IQMF(k, n) = \frac{1}{64}\exp\left(j\frac{\pi}{128}(k + 0.5)(2n - 255)\right), \quad \text{(Eq. 10)}$$

$$0 \le k < 64,\ 0 \le n < 128$$

where IQMF(k, n) is a complex QMF that uses time n and frequency k as variables.

When the time-frequency converter 11 is using fast Fourier transform, discrete cosine transform, modified discrete cosine transform, or another type of time-frequency conversion processing, the frequency-time converter 19 uses the inverse transform of the time-frequency conversion processing that the time-frequency converter 11 is using. The frequency-time converter 19 outputs, to the AAC coder 20, the channel-specific stereo signal resulting from the frequency-time conversion on the channel-specific frequency signal.

Each time the AAC coder 20 receives a channel-specific stereo signal, the AAC coder 20 creates an AAC code by coding the low-frequency components of the channel-specific stereo signal according to the AAC coding method. In this coding, the AAC coder 20 may use a technology disclosed in, for example, Japanese Laid-open Patent Publication No. 2007-183528. Specifically, the AAC coder 20 performs discrete cosine transform on the received channel-specific stereo signal to create a stereo frequency signal again. The AAC coder 20 then calculates perceptual entropy (PE) from the recreated stereo frequency signal. PE indicates the amount of information used to quantize the block so that the listener does not perceive noise.

PE has a property that has a large value for an attack sound generated from, for example, a percussion or another sound the signal level of which changes in a short time. Accordingly, the AAC coder 20 shortens windows for frames that have a relatively large PE value and prolongs windows for blocks that have a relatively small PE value. For example, a short window has 256 samples and a long window has 2048 samples. The AAC coder 20 uses a window having a predetermined length to execute modified discrete cosine transform (MDCT) on a channel-specific stereo signal so that the channel-specific stereo signal is converted to MDCT coefficients. The AAC coder 20 then quantizes the MDCT coefficients and performs variable-length coding on the quantized MDCT coefficients. The AAC coder 20 outputs, to the multiplexer 22, the variable-length coded MDCT coefficients as well as quantized coefficients and related information, as the AAC code.

The spatial information coder 21 codes the spatial information received from the first down-mixing unit 12 and the channel prediction coefficients received from the channel prediction coefficient coder 14 to create an MPEG Surround code (referred to below as the MPS code).

The spatial information coder 21 references a quantization table that indicates correspondence between similarity values and index values in the spatial information and determines, for each frequency band, the index value that is closest to similarity $ICC_i(k)$ (i=L, R, 0). The quantization table is prestored in a memory provided in the spatial information coder 21.

FIG. 2 illustrates an example of the quantization table of similarity. In the quantization table 200 in FIG. 2, each cell in the upper row 210 indicates an index value and each cell in the lower row 220 indicates the typical value of the similarity corresponding to the index value in the same column. The range of values that may be taken as the similarity is from −0.99 to +1. If, for example, the similarity in frequency band k is 0.6, the quantization table 200 indicates that the typical value of the similarity corresponding to an index value of 3 is closest to the similarity in frequency band k. Accordingly, the spatial information coder 21 set the index value in frequency band k to 3.

Next, the spatial information coder 21 obtains inter-index differences in the frequency direction for each frequency band. If, for example, the index value in frequency k is 3 and the index value in frequency band (k−1) is 0, then the spatial information coder 21 takes 3 as the inter-index difference in frequency band k.

The spatial information coder 21 references a coding table that indicates correspondence between inter-index differences and similarity codes and determines similarity code $idxicc_i(k)$ (i=L, R, 0) corresponding to a difference between indexes for each frequency band of similarity $ICC_i(k)$ (i=L, R, 0). The coding table is prestored in the memory provided in the spatial information coder 21 or another place. The similarity code may be, for example, a Huffman code, an arithmetic code, or another variable-length code that is more prolonged as the frequency at which the difference appears becomes higher.

FIG. 3 illustrates an example of a table that indicates relationships between inter-index differences and similarity codes. In the example in FIG. 3, similarity codes are Huffman codes. In the coding table 300 in FIG. 3, each cell in the left column indicates a difference between indexes and each cell in the right column indicates a similarity code corresponding to the difference in the same row. If, for example, the difference between indexes for similarity $ICC_L(k)$ in frequency band k is 3, the spatial information coder 21 references the coding table 300 and sets similarity code $idxicc_L(k)$ for similarity $ICC_L(k)$ in frequency band k to 111110.

The spatial information coder 21 references a quantization table that indicates correspondence between differences in strength and index values and determines, for each frequency band, the index value that is closest to strength difference $CLD_j(k)$ (j=L, R, C, 1, 2). The spatial information coder 21 determines, for each frequency band, differences between indexes in the frequency direction. If, for example, the index value in frequency band k is 2 and the index value in frequency band (k−1) is 4, the spatial information coder 21 sets a difference between these indexes in frequency band k to −2.

The spatial information coder 21 references a coding table that indicates correspondence between inter-index differences and strength difference codes and determines strength difference code $idxcld_j(k)$ (j=L, R, C) for the difference in each frequency band k of strength difference $CLD_j(k)$. As with the similarity code, the strength difference code may be, for example, a Huffman code, an arithmetic code, or another variable-length code that is more prolonged as the frequency at which the difference appears becomes higher. The quantization table and coding tables are prestored in the memory provided in the spatial information coder 21.

FIG. 4 illustrates an example of the quantization table of differences in strength. In the quantization table 400 in FIG. 4, the cells in rows 410, 430, and 450 indicate index values and the cells in rows 420, 440, and 460 indicate typical strength differences corresponding to the index values in the cells in the rows 410, 430, and 450 in the same columns. If, for example, strength difference $CLD_L(k)$ in frequency band k is 10.8 dB, the typical value of the strength difference corresponding to an index value of 5 is closest to $CLD_L(k)$ in the quantization table 400. Accordingly, the spatial information coder 21 sets the index value for $CLD_L(k)$ to 5.

The spatial information coder 21 uses similarity code $idxicc_i(k)$, strength difference code $idxcld_j(k)$, and channel prediction coefficient code $idxc_m(k)$, which will be described later, to create an MPS code. For example, the spatial information coder 21 places similarity code $idxicc_i(k)$, strength difference code $idxcld_j(k)$, and channel prediction coefficient code $idxc_m(k)$ in a given order to create the MPS code. The given order is described in, for example, ISO/IEC 23003-1: 2007. The spatial information coder 21 outputs the created MPS code to the multiplexer 22.

Figure 5:
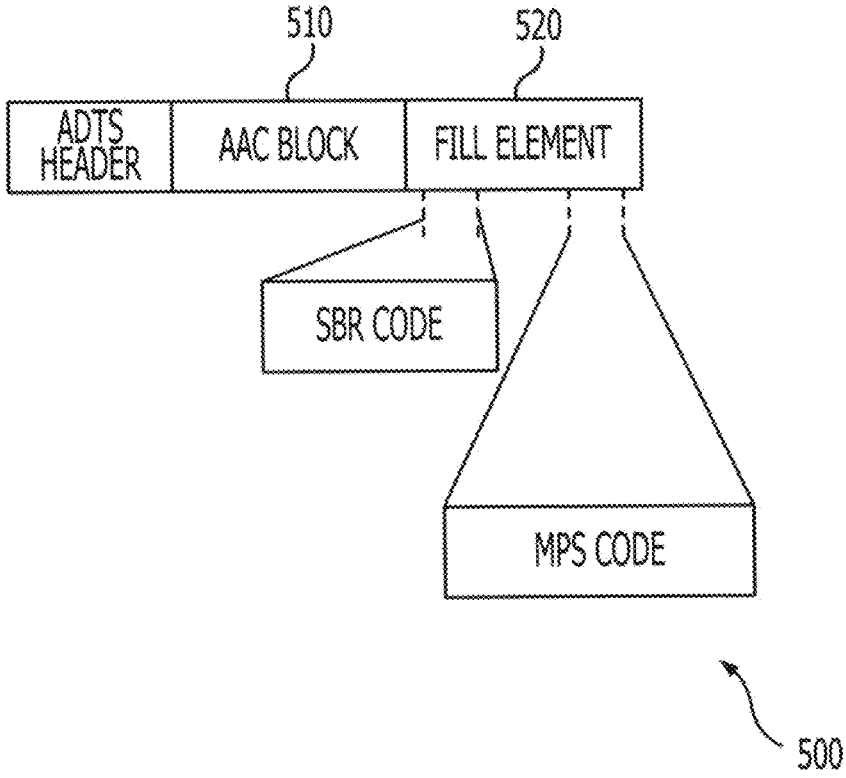
FIG. 5 illustrates an example of the format of data in which a coded audio signal is stored.

The multiplexer 22 places the AAC code, SBR code, and MPS code in a given order to multiplex them. The multiplexer 22 then outputs the coded audio signal resulting from multiplexing. FIG. 5 illustrates an example of the format of data in which a coded audio signal is stored. In the example in FIG. 5, the coded audio signal is created according to the MPEG-4 audio data transport stream (ADTS) format. In a coded data string 500 illustrated in FIG. 5, the AAC code is stored in a data block 510 and the SBR code and MPS code are stored in partial area in a block 520, in which an ADTS-format fill element is stored.

As described above, the channel prediction coefficient coder 14 handles the distribution of error d that is taken when a plurality of channel prediction coefficients included in the code book are used, as a quadratic surface. Specifically, the channel prediction coefficient coder 14 handles the distribution of error d as either an elliptic paraboloid or a parabolic cylindrical surface. In this embodiment, the reason why the distribution of error d may be handed as a quadratic surface and the reason why the distribution of error d may be handed as an elliptic paraboloid or a parabolic cylindrical surface among quadratic surfaces will be described below. The method of calculating the minimum value on the quadratic surface, that is, the arithmetic minimum value of error d will also be described.

First, the reason why the distribution of error d may be handed as a quadratic surface will be described. Error d may be defined by the first equation in Eq. 9 above. The equations in Eq. 9 may be rewritten as the equations below.

$$f(L_0, L_0)\cdot c1^2 + f(R_0, R_0)\cdot c2^2 + 2f(L_0, R_0)\cdot c1\cdot c2 - 2f(L_0, C_0)\cdot c1 - 2f(R_0, C_0)\cdot c2 + f(C_0, C_0) - d = 0 \quad \text{(Eq. 11)}$$

-continued $$f(x, y) = \sum_k \sum_n \left\{ \begin{array}{l} \mathrm{Re}(x(k, n)) \cdot \mathrm{Re}(y(k, n)) + \\ \mathrm{Im}(x(k, n)) \cdot \mathrm{Im}(y(k, n)) \end{array} \right\}$$

where Re(x(k, n)) and Re(y(k, n) are respectively the real components of frequency signals x(k, n) and y(k, n) or the real components of channel signals x(k, n) and y(k, n), and Im(x (k, n), and Im(y(k, n) are respectively the imaginary components of frequency signals x(k, n) and y(k, n) or the real components of channel signals x(k, n) and y(k, n). It may be interpreted that the equations in Eq. 11 represent a quadratic surface for channel prediction coefficients c1 and c2 when error d is a fixed value, the cross section of a distribution form being a quadratic curve. This indicates that when a plurality of channel prediction coefficients included in the code book are used, the distribution of error d may be handed as a quadratic surface.

Next, the reason why the distribution of error d may be handed as an elliptic paraboloid or a parabolic cylindrical surface among quadratic surfaces will be described below by using a quadratic curve that represents a cross section of a distribution shape obtained when error d is a fixed value. First, an ordinary equation of a quadratic curve is indicated below.

$$\alpha x^2+2\beta xy+\gamma y^2+2\delta x+2\epsilon y+\zeta=0 \quad \text{(Eq. 12)}$$

The variables in the ordinary equations in Eq. 11 and Eq. 12 above are defined as described below.

$$\alpha=f(L_0,L_0)$$

$$\beta=f(L_0,R_0)$$

$$\gamma=f(R_0,R_0)$$

$$\delta=-f(L_0,C_0)$$

$$\epsilon=-f(R_0,C_0)$$

$$\zeta=f(C_0,C_0)-d$$

It is generally known that a quadratic curve is any one of a parabola, a hyperbola, two parallel straight lines, and an ellipse, so when the following equations are met, the quadratic curve is a parabola.

$$(\beta=0,\gamma=0,\text{and } \epsilon\neq 0)$$

$$\text{or}(\beta=0,\alpha=0,\text{and } \delta\neq 0) \quad \text{(Eq. 13)}$$

When the following equation is met, the quadratic curve is a hyperbola.

$$\beta^2-\alpha\gamma>0 \quad \text{(Eq. 14)}$$

When the following equations are met, the quadratic curve is two parallel straight lines.

$$\beta^2-\alpha\gamma=0 \text{ and}$$

$$\text{other than}\{(\beta=0,\gamma=0,\text{and } \epsilon\neq 0)\text{or}(\beta=0,\alpha=0,\text{and } \delta\neq 0)\} \quad \text{(Eq. 15)}$$

When the following equation is met, the quadratic curve is an ellipse.

$$\beta^2-\alpha\gamma<0 \quad \text{(Eq. 16)}$$

When the properties of left-side frequency signal $L_0(k, n)$, right-side frequency signal $R_0(k, n)$, and central-channel frequency signal $C_0(k, n)$, which are signals received by the determining unit 15 in the channel prediction coefficient coder 14, are considered, the conditions for a parabola and a hyperbola are not met. The reason for this will be described below.

First, the reason why the condition for a parabola is not met will be described, starting with a case in which γ is assumed to be 0 in the equations in Eq. 13 above. When γ is 0, $R_0(k, n)$ becomes 0 for all (k, n) values according to the equation below.

$$\gamma = f(R_0, R_0) == \sum_k \sum_n \{|R_0(k, n)|^2\} = 0 \quad \text{(Eq. 17)}$$

In this case, ϵ becomes 0 according to the equation below.

$$\begin{aligned} \varepsilon &= -f(R_0, C_0) \quad \text{(Eq. 18)} \\ &= \sum_k \sum_n \left\{ \begin{array}{l} \mathrm{Re}(R_0(k, n)) \cdot \mathrm{Re}(C_0(k, n)) + \\ \mathrm{Im}(R_0(k, n)) \cdot \mathrm{Im}(C_0(k, n)) \end{array} \right\} \\ &= \sum_k \sum_n \{0 \cdot \mathrm{Re}(C_0(k, n)) + 0 \cdot \mathrm{Im}(C_0(k, n))\} = 0 \end{aligned}$$

When α is assumed to be 0, δ becomes 0 in a similar calculation. Thus, the condition for a parabola, which is indicated by the equations in Eq. 13 above, is not met in any case.

Next, the reason why the condition for a hyperbola is not met will be described. The inequality in Eq. 14 above may be rewritten as follows.

$$\begin{aligned} & f(L_0, R_0)^2 - f(L_0, L_0) \times f(R_0, R_0) = \quad \text{(Eq. 19)} \\ & \left[\sum_k \sum_{n=0} \{\mathrm{Re}(L_0) \cdot \mathrm{Re}(R_0) + \mathrm{Im}(L_0) \cdot \mathrm{Im}(R_0)\}\right]^2 - \\ & \sum_k \sum_{n=0} \{\mathrm{Re}(L_0)^2 + \mathrm{Im}(L_0)^2\} \times \sum_k \sum_{n=0} \{\mathrm{Re}(R_0)^2 + \mathrm{Im}(R_0)^2\} \end{aligned}$$

The equation in Eq. 19 meets the equation below due to Cauchy-Schwarz inequality.

$$\begin{aligned} & \sum_k \sum_{n=0} \{\mathrm{Re}(L_0)^2 + \mathrm{Im}(L_0)^2\} \times \sum_k \sum_{n=0} \{\mathrm{Re}(R_0)^2 + \mathrm{Im}(R_0)^2\} - \quad \text{(Eq. 20)} \\ & \left[\sum_k \sum_{n=0} \left\{ \begin{array}{l} \mathrm{Re}(L_0) \cdot \mathrm{Re}(R_0) + \\ \mathrm{Im}(L_0) \cdot \mathrm{Im}(R_0) \end{array} \right\}\right]^2 \leq 0 \end{aligned}$$

Thus, the condition for a hyperbola, which is indicated by the inequality in Eq. 14 above, is not met in any case.

As described above, when error d is a fixed value, the quadratic curve on the cross section of a distribution form does not the condition for a parabola or a hyperbola. That is, Eq. 11 above indicates that when error d is a fixed value, the quadratic curve on the cross section of a distribution form may be handled as two parallel straight lines or an ellipse.

When two parallel straight lines are defined as a quadratic surface for channel prediction coefficients c1 and c2, the quadratic surface becomes a parabolic cylindrical surface. When an ellipse is defined as a quadratic surface for channel prediction coefficients c1 and c2, the quadratic surface becomes an elliptic paraboloid. That is, when a plurality of channel prediction coefficients included in the code book are used, the determining unit 15 in the channel prediction coefficient coder 14 may handle the distribution of error d as a quadratic surface that is either a parabolic cylindrical surface or an elliptic paraboloid.

When a plurality of channel prediction coefficients included in the code book are used, the determining unit 15 in the channel prediction coefficient coder 14 may determine whether the distribution of error d is to be handled as a parabolic cylindrical surface or an elliptic paraboloid depending on whether the inequality in Eq. 16 above is met, according to left-side frequency signal $L_0(k, n)$, right-side frequency signal $R_0(k, n)$, and central-channel frequency signal $C_0(k, n)$.

At the minimum value on a quadratic surface that is either a parabolic cylindrical surface or an elliptic paraboloid, error d is arithmetically minimized. The method used by the calculating unit 16 in the channel prediction coefficient coder 14 to calculate channel prediction coefficients differs depending on whether the minimum value is present within the code book range defined by the minimum channel prediction coefficient and maximum channel prediction coefficient included in the code book, so methods of calculating the minimum value will be described below. First, the method of calculating the minimum value when the quadratic surface is handled as a parabolic cylindrical surface will be described. When the conditions in Eq. 15 above are met, any of the following equations is met.

$$\begin{aligned}
&(i)\ \mathrm{Re}\{L_0(0,0)\} = \mathrm{Re}\{L_0(0,1)\} = \ldots = \mathrm{Re}\{L_0(k,n)\} = \\
&\qquad \mathrm{Im}\{L_0(0,0)\} = \mathrm{Im}\{L_0(0,1)\} = \ldots = \mathrm{Im}\{L_0(k,n)\} = 0 \\
&(ii)\ \mathrm{Re}\{R_0(,0)\} = \mathrm{Re}\{R_0(0,1)\} = \ldots = \mathrm{Re}\{R_0(k,n)\} = \\
&\qquad \mathrm{Im}\{R_0(0,0)\} = \mathrm{Im}\{R_0(0,1)\} = \ldots = \mathrm{Im}\{R_0(k,n)\} = 0 \\
&(iii)\ \frac{\mathrm{Re}\{L_0(0,0)\}}{\mathrm{Re}\{R_0(0,0)\}} = \frac{\mathrm{Re}\{L_0(0,1)\}}{\mathrm{Re}\{R_0(0,1)\}} = \ldots = \frac{\mathrm{Re}\{L_0(k,n)\}}{\mathrm{Re}\{R_0(k,n)\}} = \\
&\qquad \frac{\mathrm{Im}\{L_0(0,0)\}}{\mathrm{Im}\{R_0(0,0)\}} = \frac{\mathrm{Im}\{L_0(0,1)\}}{\mathrm{Im}\{R_0(0,1)\}} = \ldots = \frac{\mathrm{Im}\{L_0(k,n)\}}{\mathrm{Im}\{R_0(k,n)\}}
\end{aligned} \tag{Eq. 21}$$

A case in which equation (iii) in Eq. 21 is met will be described. Equation (iii) in Eq. 21 may be rewritten as follows.

$$\frac{\mathrm{Re}\{L_0(k,n)\}}{\mathrm{Re}\{R_0(k,n)\}} = \frac{\mathrm{Im}\{L_0(k,n)\}}{\mathrm{Im}\{R_0(k,n)\}} = \frac{1}{s} \tag{Eq. 22}$$

where s is an arbitrary real number. When the equation in Eq. 22 is substituted for each term in the equation in Eq. 11, error d may be represented as follows.

$$d = f(L_0, L_0)(c1 + s \cdot c2)^2 - 2f(L_0, \hat{C}_0)(c1 + s \cdot c2) + f(\hat{C}_0, \hat{C}_0) \tag{Eq. 23}$$

In Eq. 23, (c1+s·c2) is a linear expression of c1 and c2. When (c1+s·c2) in Eq. 23 is replaced with variable z and constants that are uniquely determined from left-side frequency signal $L_0(k, n)$, right-side frequency signal $R_0(k, n)$, and central-channel frequency signal $C_0(k, n)$ are replaced with A, B, C, and D, the equation in Eq. 23 may be represented by the following ordinary equation of a parabola.

$$A \times z^2 - B \times z + C - d = 0 \tag{Eq. 24}$$

Figure 6:
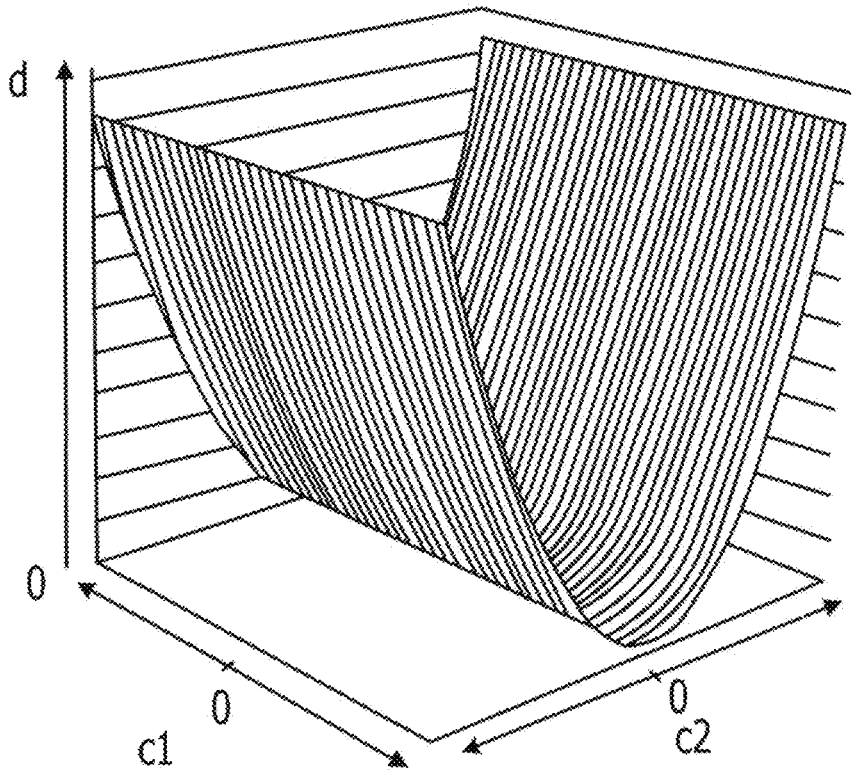
FIG. 6 is a conceptual diagram illustrating an error distribution form in the form of a parabolic cylindrical surface on which channel prediction coefficients c1 and c2 and error d are used as coordinates.

Since $f(L_0, L_0)$ in Eq. 23 is a positive value in all cases, the distribution form of error on the parabolic cylindrical surface, on which channel prediction coefficients c1 and c2 and error d are used as coordinates, has the minimum value in the c1-c2 plane of channel prediction coefficients. FIG. 6 is a conceptual diagram illustrating an error distribution form in the form of a parabolic cylindrical surface on which channel prediction coefficients c1 and c2 and error d are used as coordinates. As illustrated in FIG. 6, the minimum value of error d is present on a straight line in the c1-c2 plane of channel prediction coefficients; the value of error d become large along the parabola, starting from the straight line. To simplify descriptions below, the error distribution form in the form of a parabolic cylindrical surface will be referred to as the parabolic cylindrical surface type. The minimum value of the parabolic cylindrical surface type becomes linear, as represented by the equation below.

$$(c1 + s \cdot c2) = \frac{f(L_0, \hat{C}_0)}{f(L_0, L_0)} \tag{Eq. 25}$$

The reason why $f(L_0, L_0)$ in Eq. 23 above is a positive value in all cases will be described as a supplement. When it is defined for f(x, y) in the equation in Eq. 11 that x is $L_0$ and y is $L_0$, f(x, y) may be represented by the equation below.

$$f(L_0, L_0) = \sum_k \sum_n \left\{ \begin{array}{l} \mathrm{Re}(L_0(k,n)) \cdot \mathrm{Re}(L_0(k,n)) + \\ \mathrm{Im}(L_0(k,n)) \cdot \mathrm{Im}(L_0(k,n)) \end{array} \right\} \tag{Eq. 26}$$

The equation in Eq. 26 may be rewritten as the equation below.

$$\begin{aligned}
f(L_0, L_0) &= \sum_k \sum_n \{\mathrm{Re}(L_0(k,n))^2 + \mathrm{Im}(L_0(k,n))^2\} \\
&= \sum_k \sum_n \{|L_0(k,n)|^2\}
\end{aligned} \tag{Eq. 27}$$

Since each term in the total sum is 0 or more in all cases as indicated by the equation in Eq. 26, $f(L_0, L_0)$ is a positive value of 0 or more in all cases. If $L_0(k, n)$ is 0 for all (k, n) values, $f(L_0, L_0)$ is not a positive value but 0. In this case, however, the condition in (i) in Eq. 21 above is met, so when the condition for (iii) is met, $f(L_0, L_0)$ is a positive value in all cases.

In a case as well in which the conditions in (i) and (ii) in Eq. 21 are met, the minimum value of the parabolic cylindrical surface type may be obtained by a similar calculation. When the condition in (i) in Eq. 21 is met, the minimum value of the parabolic cylindrical surface type becomes linear as represented by the equation below.

$$c2 = \frac{f(R_0, C_0)}{f(R_0, R_0)} \tag{Eq. 28}$$

where c1 is an arbitrary value.

When the condition in (ii) in Eq. 21 is met, the minimum values of the parabolic cylindrical surface type become linear as represented by the equation below.

$$c1 = \frac{f(L_0, C_0)}{f(L_0, L_0)} \tag{Eq. 29}$$

where c2 is an arbitrary value.

Next, the method of calculating the minimum value taken when the quadratic surface is handled as an elliptic paraboloid will be described. The equation in Eq. 11 above may be represented by the following ordinary equation of an ellipse that performs an orthogonal transform by replacing constants that are uniquely determined from left-side frequency signal $L_0(k, n)$, right-side frequency signal $R_0(k, n)$, and central-channel frequency signal $C_0(k, n)$ with A, B, C, D, and E.

$$A\cdot(c1-B)^2+C(c2-D)^2=d+E \quad \text{(Eq. 30)}$$

Figure 7:
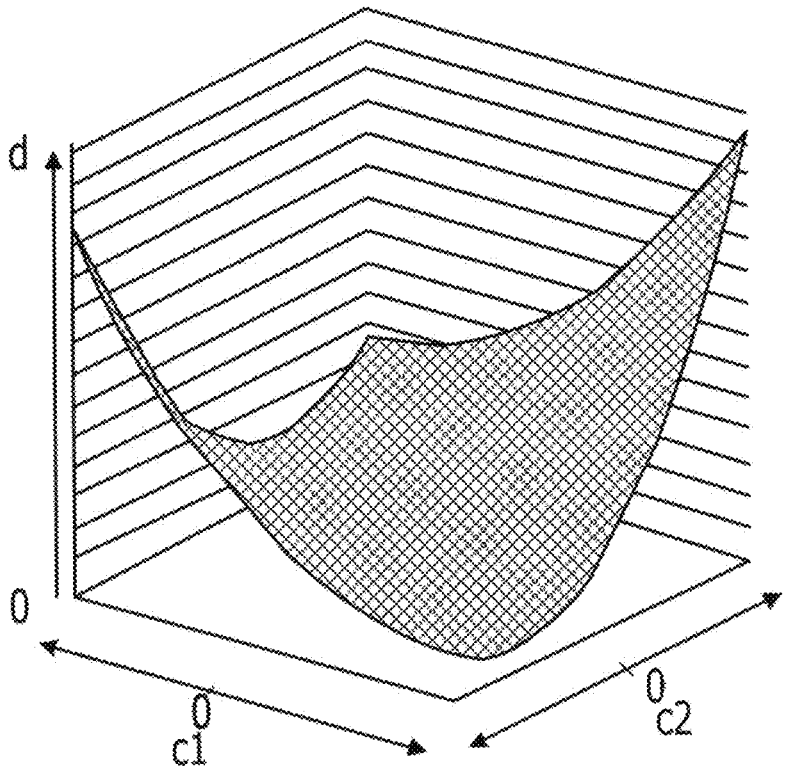
FIG. 7 is a conceptual diagram illustrating an error distribution form in the form of an elliptic paraboloid on which channel prediction coefficients c1 and c2 and error d are used as coordinates.

According to the equation in Eq. 30, an elliptic paraboloid is formed so that the center, at which error d is minimized, becomes (B, D) and the radius of the ellipse becomes larger as d become larger. FIG. 7 is a conceptual diagram illustrating an error distribution form in the form of an elliptic paraboloid on which channel prediction coefficients c1 and c2 and error d are used as coordinates. As illustrated in FIG. 7, the elliptic paraboloid is such that the radius of the ellipse becomes larger as d become larger, starting from the center at which error d is minimized. To simplify descriptions below, the error distribution form in the form of an elliptic paraboloid will be referred to as the elliptic paraboloid type. In the equation in Eq. 30, (B, D) at which error d is minimized, that is, (c1, c2), may be calculated by the equation below.

$$c1 = \frac{f(L_0, R_0)\cdot f(R_0, C_0) - f(L_0, C_0)\cdot f(R_0, R_0)}{f(L_0, R_0)\cdot f(L_0, R_0) - f(L_0, L_0)\cdot f(R_0, R_0)} \quad \text{(Eq. 31)}$$

$$c2 = \frac{f(L_0, C_0)\cdot f(L_0, R_0) - f(L_0, L_0)\cdot f(R_0, C_0)}{f(L_0, R_0)\cdot f(L_0, R_0) - f(L_0, L_0)\cdot f(R_0, R_0)}$$

$$f(x, y) = \sum_k \sum_n \left\{ \begin{array}{l} \mathrm{Re}(x(k, n))\cdot \mathrm{Re}(y(k, n)) + \\ \mathrm{Im}(x(k, n))\cdot \mathrm{Im}(y(k, n)) \end{array} \right\}$$

As described above, the calculating unit 16 in the channel prediction coefficient coder 14 may calculate the minimum value, on a quadratic surface that is either a parabolic cylindrical surface or an elliptic paraboloid, at which error d is arithmetically minimized. Next, the method of determining whether the minimum value calculated by the calculating unit 16 in the channel prediction coefficient coder 14 is present within the code book range will be described, the code book range being defined by the minimum channel prediction coefficient and maximum channel prediction coefficient included in the code book.

Figure 8A:
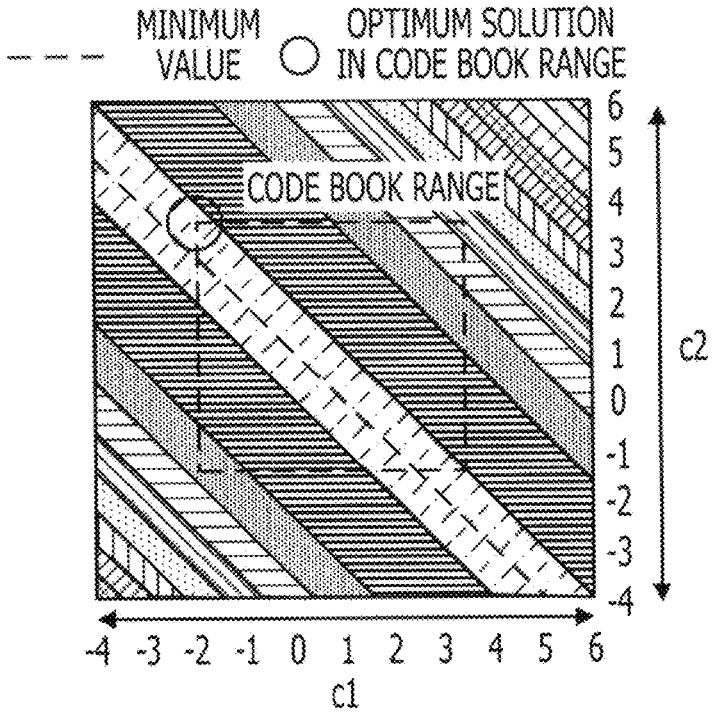
FIG. 8A is a conceptual diagram illustrating an optimum solution in a case in which the minimum value on the parabolic cylindrical surface in the c1-c2 plane of channel prediction coefficients is present within a code book range, and FIG.
Figure 8B:
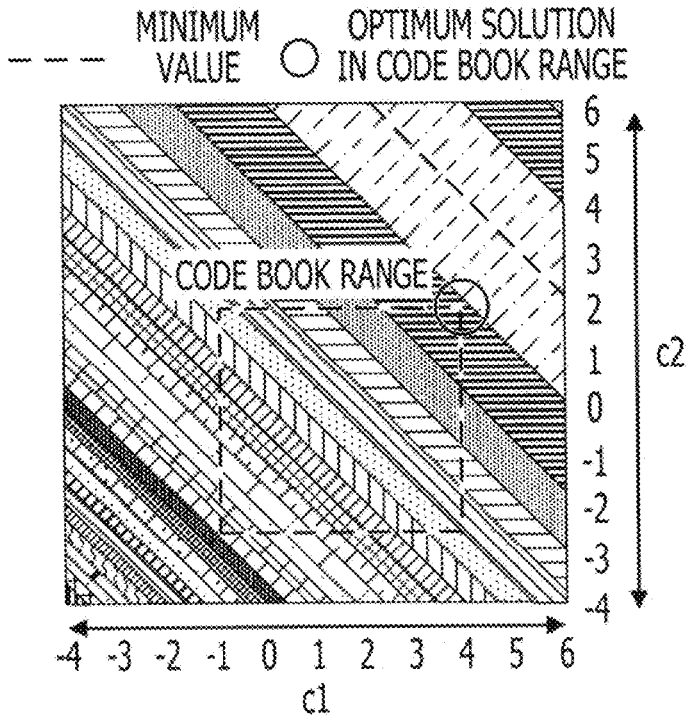

Code book range determination when the distribution of error d is handed as a parabolic cylindrical surface:

Code book range determination will be described in which whether the minimum value is present within or outside the code book range when the distribution of error d is handed as a parabolic cylindrical surface. FIG. 8A is a conceptual diagram illustrating an optimum solution in a case in which the minimum value on the parabolic cylindrical surface in the c1-c2 plane of channel prediction coefficients is present within the code book range, and FIG. 8B is a conceptual diagram illustrating an optimum solution in a case in which the minimum value on the parabolic cylindrical surface in the c1-c2 plane of channel prediction coefficients is present outside the code book range. In FIGS. 8A and 8B, hatching drawn in the c1-c2 plane of channel prediction coefficients indicates any of segments into which the curvature of the parabolic cylindrical surface has been divided. As illustrated in FIGS. 8A and 8B, the minimum value of error d is present on a straight line in the c1-c2 plane of channel prediction coefficients. The inclination of the straight line that meets the minimum value indicates a monotonous increase or monotonous decrease in the c1-c2 plane of channel prediction coefficients due to the nature of the equations in Eq. 25, Eq. 28, and Eq. 29 above. Alternatively, the straight line becomes parallel to the axis of channel prediction coefficient c1 or c2. The determination equations below may be used to determine whether the straight line is inclined so as to monotonously increase or decrease or is parallel to the axis of channel prediction coefficient c1 or c2.

$$\begin{aligned}
&(i)\ \mathrm{Re}\{L_0(0, 0)\} = \mathrm{Re}\{L_0(0, 1)\} = \ldots = \mathrm{Re}\{L_0(k, n)\} = \\
&\qquad \mathrm{Im}\{L_0(0, 0)\} = \mathrm{Im}\{L_0(0, 1)\} = \ldots = \mathrm{Im}\{L_0(k, n)\} = 0 \\
&(ii)\ \mathrm{Re}\{R_0(0, 0)\} = \mathrm{Re}\{R_0(0, 1)\} = \ldots = \mathrm{Re}\{R_0(k, n)\} = \\
&\qquad \mathrm{Im}\{R_0(0, 0)\} = \mathrm{Im}\{R_0(0, 1)\} = \ldots = \mathrm{Im}\{R_0(k, n)\} = 0 \\
&(iii)\ \frac{\mathrm{Re}\{L_0(0, 0)\}}{\mathrm{Re}\{R_0(0, 0)\}} = \frac{\mathrm{Re}\{L_0(0, 1)\}}{\mathrm{Re}\{R_0(0, 1)\}} = \ldots = \frac{\mathrm{Re}\{L_0(k, n)\}}{\mathrm{Re}\{R_0(k, n)\}} = \\
&\qquad \frac{\mathrm{Im}\{L_0(0, 0)\}}{\mathrm{Im}\{R_0(0, 0)\}} = \frac{\mathrm{Im}\{L_0(0, 1)\}}{\mathrm{Im}\{R_0(0, 1)\}} = \ldots = \frac{\mathrm{Im}\{L_0(k, n)\}}{\mathrm{Im}\{R_0(k, n)\}} > 0 \\
&(iv)\ \frac{\mathrm{Re}\{L_0(0, 0)\}}{\mathrm{Re}\{R_0(0, 0)\}} = \frac{\mathrm{Re}\{L_0(0, 1)\}}{\mathrm{Re}\{R_0(0, 1)\}} = \ldots = \frac{\mathrm{Re}\{L_0(k, n)\}}{\mathrm{Re}\{R_0(k, n)\}} = \\
&\qquad \frac{\mathrm{Im}\{L_0(0, 0)\}}{\mathrm{Im}\{R_0(0, 0)\}} = \frac{\mathrm{Im}\{L_0(0, 1)\}}{\mathrm{Im}\{R_0(0, 1)\}} = \ldots = \frac{\mathrm{Im}\{L_0(k, n)\}}{\mathrm{Im}\{R_0(k, n)\}} < 0
\end{aligned} \quad \text{(Eq. 32)}$$

In Eq. 32, if the condition in (i) is met, the straight line becomes parallel to the axis of channel prediction coefficient c1; if the condition in (ii) is met, the straight line becomes parallel to the axis of channel prediction coefficient c2; if the condition in (iii) is met, the straight line is inclined so as to monotonously decrease in the c1-c2 plane of channel prediction coefficients; if the condition in (iv) is met, the straight line is inclined so as to monotonously increase in the c1-c2 plane of channel prediction coefficients. The code book range determination method differs depending on which condition is met, as described below.

When the minimum value on the parabolic cylindrical surface is parallel to the axis of channel prediction coefficient c1:

First, a case in which the minimum value on the parabolic cylindrical surface is parallel to the axis of channel prediction coefficient c1 will be described. Minimum value c2 is uniquely calculated to be m2 according to the equation in Eq. 28 above (the value of c1 is arbitrary). Then, if the inequalities below hold, it is determined that the minimum value is present within the code book range. If the inequalities below do not hold, it is determined that the minimum value is present outside the code book range.

$$c\mathrm{Min} \le m2 \text{ and } c\mathrm{Max} \ge m2 \quad \text{(Eq. 33)}$$

In Eq. 33, cMin is the minimum channel prediction coefficient included in the code book and cMax is the maximum channel prediction coefficient included in the code book. This is also true for the subsequent equations. Since it is desirable to use channel prediction coefficients included in the code book, c1 is desirably at least cMin and at most cMax and c2 is desirably at least cMin and at most cMax in the inequalities in Eq. 33 and subsequent equations as well.

When the minimum value on the parabolic cylindrical surface is parallel to the axis of channel prediction coefficient c2:

A case in which the minimum value on the parabolic cylindrical surface is parallel to the axis of channel prediction coefficient c2 will be described below. Minimum value c1 is uniquely calculated to be m1 according to the equation in Eq. 29 above (the value of c2 is arbitrary). Then, if the inequalities below hold, it is determined that the minimum value is present within the code book range. If the inequalities do not hold, it is determined that the minimum value is present outside the code book range.

$$c\text{Min} \le m1 \text{ and } c\text{Max} \ge m1 \quad \text{(Eq. 34)}$$

When the minimum value on the parabolic cylindrical surface monotonously decreases in the c1-c2 plane of channel prediction coefficients:

Next, a case in which the minimum value on the parabolic cylindrical surface monotonously decreases in the c1-c2 plane will be described. The minimum value is uniquely calculated to be a point on the straight line that meets the condition that (c1+s·c2) equals m3, according to the equation in Eq. 25 above. However, s is greater than 0 due to the conditions in Eq. 22 and Eq. 32 above. Then, when the value of c1 is determined under the condition that c2 equals cMin and the value of c1 is also determined under the condition that c2 equals cMax, it may be determined whether the straight line that meets the condition that (c1+s·c2) equals m3 is passing within the code book range. Specifically, if the inequalities below are met, the minimum value is determined to be present within the code book, and if not, the minimum value is determined to be present outside the code book.

$$m^3 - s \cdot c\text{Min} \ge c\text{Min} \text{ and } m^3 - s \cdot c\text{Max} \le c\text{Max} \quad \text{(Eq. 35)}$$

When the minimum value on the parabolic cylindrical surface monotonously increases in the c1-c2 plane of channel prediction coefficients:

A case in which the minimum value on the parabolic cylindrical surface monotonously increases in the c1-c2 plane will be described below. The minimum value is a point on the straight line that meets the condition that (c1+s·c2) equals m3, according to the equation in Eq. 25 above. However, s is smaller than 0 due to the conditions in Eq. 22 and Eq. 32 above. Then, when the value of c1 is determined under the condition that c2 equals cMin and the value of c1 is also determined under the condition that c2 equals cMax, it may be determined whether the straight line that meets the condition that (c1+s·c2) equals m3 is passing within the code book range. If the inequalities below are met, the minimum value is determined to be present within the code book, and if not, the minimum value is determined to be present outside the code book.

$$m^3 - s \cdot c\text{Min} \le c\text{Max} \text{ and } m^3 - s \cdot c\text{Max} \ge c\text{Min} \quad \text{(Eq. 36)}$$

Thus, when the distribution of error d is handled as a parabolic cylindrical surface, it may be determined according to the equations in Eq. 32 above whether the straight line that meets the minimum value monotonously increases or decreases in the c1-c2 plane of channel prediction coefficients or is parallel to the axis of channel prediction coefficient c1 or c2. It may also be determined from the inequalities in Eq. 33 to Eq. 36 whether the minimum value is present within the code book range.

Code book range determination when the distribution of error d is handled as a parabolic cylindrical surface:

Next, code book range determination will be described in which it is determined whether the minimum value is present within or outside the code book range when the distribution of error d is handled as a parabolic cylindrical surface. FIG. 9A is a conceptual diagram illustrating an optimum solution in a case in which the minimum value on the elliptic paraboloid in the c1-c2 plane of channel prediction coefficients is present within the code book range. FIG. 9B is a conceptual diagram illustrating the optimum solution in a case in which the minimum value on the elliptic paraboloid in the c1-c2 plane of channel prediction coefficients is present outside the code book range. In FIGS. 9A and 9B, hatching drawn in the c1-c2 plane of channel prediction coefficients indicates any of segments into which the curvature of the elliptic paraboloid has been divided. The minimum value (c1, c2), calculated according to the equation in Eq. 29 above, is assumed to be (m1, m2). When (m1, m2) is present within the code book range, if the equalities in Eq. 37 are met, the minimum value is determined to be present within the code book range. If not, the minimum value is determined to be present outside the code book range.

$$c\text{Min} \le m1, c\text{Max} \ge m1, c\text{Min} \le m2, \text{and } c\text{Max} \ge m2 \quad \text{(Eq. 37)}$$

Calculation of channel prediction coefficients included in the code book according to the calculated minimum value and to the code book range determination result:

Next, a method of calculating a channel prediction coefficient included in the code book according to the calculated minimum value and to the code book range determination result will be described. The calculation method differs depending on whether the distribution of error d is to be handled as an elliptic paraboloid or a parabolic cylindrical surface and whether the minimum value is present within the code book range. Cases in which these conditions are combined will be described. In any case, when the minimum value is present outside the code book range, it is difficult to use the calculated minimum value as a channel prediction coefficient due to the restriction imposed by the use of the code book. Therefore, a point at which a quadratic curve that is either on a parabolic cylindrical surface or an elliptic paraboloid comes into contact with a boundary of the code book range is calculated as an optimum solution provided under the restriction under which error d uses the code book. The calculated optimum solution is used as the channel prediction coefficient included in the code book. If the minimum value is present within the code book range, the calculated minimum value may be used as an optimum solution, that is, a channel prediction coefficient included in the code book range, without alteration.

I. Case in which the distribution of error d is handed as a parabolic cylindrical surface, the straight line that meets the minimum value on the parabolic cylindrical surface is parallel to the axis of channel prediction coefficient c1, and the minimum value is present within the code book range:

Descriptions of the methods of calculating an optimum solution begin with the method applicable to a case in which the distribution of error d is handed as a parabolic cylindrical surface, the straight line that meets the minimum value on the parabolic cylindrical surface is parallel to the axis of channel prediction coefficient c1, and the minimum value is present within the code book range. Since the minimum value is present within the code book range, the calculated minimum value may be handled as the minimum value. As described above, the minimum value meets the condition that c2 equals m2 (c1 is an arbitrary value). When the minimum value is within the code book range, c1 may be an arbitrary value. When the intersection with c1 that equals cMin is calculated, however, an optimum solution may be determined according to the equation below.

$$(c1, c2) = (c\text{Min}, m1) \quad \text{(Eq. 38)}$$

II. Case in which the distribution of error d is handed as a parabolic cylindrical surface, the straight line that meets the minimum value on the parabolic cylindrical surface is parallel to the axis of channel prediction coefficient c1, and the minimum value is present outside the code book range:

The method of calculating an optimum solution that is described below is applicable to a case in which the distribution of error d is handed as a parabolic cylindrical surface, the straight line that meets the minimum value on the parabolic cylindrical surface is parallel to the axis of channel prediction coefficient c1, and the minimum value is present outside the code book range. Since the minimum value is present outside the code book range, it is desirable to calculate, as an optimum solution, a point within the code book range at which error d is small. In the case of a parabolic cylindrical surface, the larger the distance from the straight line that meets the minimum value is, the larger error d is, as illustrated in FIG. 6, so it suffices to calculate a point at which the parabolic cylindrical surface comes into contact with a boundary of the code book range. The minimum value meets the condition that c2 equals m2 (c1 is an arbitrary value). Although c1 is an arbitrary value, when the intersection with c1 that equals cMin is calculated, however, an optimum solution may be determined according to the equations below.

$$\text{When } m2>c\text{Max},(c1,c2)=(c\text{Min},c\text{Max})$$

$$\text{When } m2<c\text{Min},(c1,c2)=(c\text{Min},c\text{Min}) \quad \text{(Eq. 39)}$$

III. Case in which the distribution of error d is handed as a parabolic cylindrical surface, the straight line that meets the minimum value on the parabolic cylindrical surface is parallel to the axis of channel prediction coefficient c2, and the minimum value is present within the code book range:

The method of calculating an optimum solution that is described below is applicable to a case in which the distribution of error d is handed as a parabolic cylindrical surface, the straight line that meets the minimum value on the parabolic cylindrical surface is parallel to the axis of channel prediction coefficient c2, and the minimum value is present within the code book range. Since the minimum value is present within the code book range, the calculated minimum value may be handled as the minimum value. The minimum value meets the condition that c1 equals m1 (c2 is an arbitrary value). When the minimum value is within the code book range, c2 may be an arbitrary value. When the intersection with c2 that equals cMin is calculated, however, an optimum solution may be determined according to the equation below.

$$(c1,c2)=(m1,c\text{Min}) \quad \text{(Eq. 40)}$$

IV. Case in which the distribution of error d is handed as a parabolic cylindrical surface, the straight line that meets the minimum value on the parabolic cylindrical surface is parallel to the axis of channel prediction coefficient c2, and the minimum value is present outside the code book range:

The method of calculating an optimum solution that is described below is applicable to a case in which the distribution of error d is handed as a parabolic cylindrical surface, the straight line that meets the minimum value on the parabolic cylindrical surface is parallel to the axis of channel prediction coefficient c2, and the minimum value is present outside the code book range. Since the minimum value is present outside the code book range, it is desirable to calculate, as an optimum solution, a point within the code book range at which error d is small. In the case of a parabolic cylindrical surface, the larger the distance from the straight line that meets the minimum value is, the larger error d is, as illustrated in FIG. 6, so it suffices to calculate a point at which the parabolic cylindrical surface comes into contact with a boundary of the code book range. The minimum value meets the condition that c1 equals m1 (c2 is an arbitrary value). Although c2 is an arbitrary value, when the intersection with c2 that equals cMin is calculated, however, an optimum solution may be determined according to the equations in below.

$$\text{When } m1>c\text{Max},(c1,c2)=(c\text{Max},c\text{Min})$$

$$\text{When } m1<c\text{Min},(c1,c2)=(c\text{Min},c\text{Min}) \quad \text{(Eq. 41)}$$

V. Case in which the distribution of error d is handed as a parabolic cylindrical surface, the straight line that meets the minimum value on the parabolic cylindrical surface monotonously decreases in the c1-c2 plane of channel prediction coefficients, and the minimum value is present within the code book range:

The method of calculating an optimum solution that is described below is applicable to a case in which the distribution of error d is handed as a parabolic cylindrical surface, the straight line that meets the minimum value on the parabolic cylindrical surface monotonously decreases in the c1-c2 plane of channel prediction coefficients, and the minimum value is present within the code book range. Since the minimum value is present within the code book range, the calculated minimum value may be handled as the minimum value. The minimum value meets the condition that (c1+s·c2) equals m3. However, s is greater than 0 due to the conditions in Eq. 22 and Eq. 32 above. Although any point that meets the condition for the minimum value and is within the code book range may be handled as an optimum solution, when the intersection between the condition for the minimum value and c1 that equals cMin or c2 that equals cMax is calculated as an optimum solution, the optimum solution may be determined according to the equations below.

$$\text{When } m3-s\cdot c\text{Max}\geq c\text{Min},(c1,c2)=(m3-s\cdot c\text{Max},c\text{Max})$$

$$\text{When } m3-s\cdot c\text{Max}<c\text{Min},(c1,c2)=(c\text{Min},(c\text{Min}-m3)/s) \quad \text{(Eq. 42)}$$

The upper equation in Eq. 42 represents the intersection between the condition for the minimum value and c2 that equals cMax. The lower equation represents the intersection between the condition for the minimum value and c1 that equals cMin.

VI. Case in which the distribution of error d is handed as a parabolic cylindrical surface, the straight line that meets the minimum value on the parabolic cylindrical surface monotonously decreases in the c1-c2 plane of channel prediction coefficients, and the minimum value is present outside the code book range:

The method of calculating an optimum solution that is described below is applicable to a case in which the distribution of error d is handed as a parabolic cylindrical surface, the straight line that meets the minimum value on the parabolic cylindrical surface monotonously decreases in the c1-c2 plane of channel prediction coefficients, and the minimum value is present outside the code book range. Since the minimum value is present outside the code book range, it is desirable to calculate, as an optimum solution, a point within the code book range at which error d is small. In the case of a parabolic cylindrical surface, the larger the distance from the straight line that meets the minimum value is, the larger error d is, as illustrated in FIG. 6, so it suffices to handle, as an optimum solution, a point at which the parabolic cylindrical surface comes into contact with a boundary of the code book range. The minimum value meets the condition that (c1+s·c2) equals m3. However, s is greater than 0 due to the conditions in Eq. 22 and Eq. 32 above. Then, an optimum solution in the code book range may be determined according to the equations below.

$$\text{When } m3-s\cdot c\text{Min}<c\text{Min},(c1,c2)=(c\text{Min},c\text{Min})$$

$$\text{When } m3-s\cdot c\text{Min}>c\text{Max},(c1,c2)=(c\text{Max},c\text{Max}) \quad \text{(Eq. 43)}$$

VII. Case in which the distribution of error d is handed as a parabolic cylindrical surface, the straight line that meets the minimum value on the parabolic cylindrical surface monotonously increases in the c1-c2 plane of channel prediction coefficients, and the minimum value is present within the code book range:

The method of calculating an optimum solution that is described below is applicable to a case in which the distribution of error d is handed as a parabolic cylindrical surface, the straight line that meets the minimum value on the parabolic cylindrical surface monotonously increases in the c1-c2 plane of channel prediction coefficients, and the minimum value is present within the code book range. Since the minimum value is present within the code book range, the calculated minimum value may be handled as the minimum value. The minimum value meets the condition that (c1+s·c2) equals m3. However, s is smaller than 0 due to the conditions in Eq. 22 and Eq. 32 above. Although any point that meets the condition for the minimum value and is within the code book range may be handled as an optimum solution, when the intersection between the condition for the minimum value and c1 that equals cMin or c2 that equals cMin is calculated as an optimum solution, the optimum solution may be determined according to the equations below.

$$\text{When } m3-s\cdot c\text{Min}\geq c\text{Min},(c1,c2)=(m3-s\cdot c\text{Min},c\text{Min})$$

$$\text{When } m3-s\cdot c\text{Max}<c\text{Min},(c1,c2)=(c\text{Min},(c\text{Min}-m3)/s) \quad \text{(Eq. 44)}$$

The upper equation in Eq. 44 represents the intersection between the condition for the minimum value and c2 that equals cMin. The lower equation represents the intersection between the condition for the minimum value and c1 that equals cMin.

VIII. Case in which the distribution of error d is handed as a parabolic cylindrical surface, the straight line that meets the minimum value on the parabolic cylindrical surface monotonously increases in the c1-c2 plane of channel prediction coefficients, and the minimum value is present outside the code book range:

The method of calculating an optimum solution that is described below is applicable to a case in which the distribution of error d is handed as a parabolic cylindrical surface, the straight line that meets the minimum value on the parabolic cylindrical surface monotonously increases in the c1-c2 plane of channel prediction coefficients, and the minimum value is present outside the code book range. Since the minimum value is present outside the code book range, it is desirable to calculate, as an optimum solution, a point within the code book range at which error d is small. In the case of a parabolic cylindrical surface, the larger the distance from the straight line that meets the minimum value is, the larger error d is, as illustrated in FIG. 6, so it suffices to handles, as an optimum solution, a point at which the parabolic cylindrical surface comes into contact with a boundary of the code book range. The minimum value meets the condition that (c1+s·c2) equals m3. However, s is smaller than 0 due to the conditions in Eq. 22 and Eq. 32 above. Then, an optimum solution in the code book range may be determined according to the equations below.

$$\text{When } m3-s\cdot c\text{Min}>c\text{Max},(c1,c2)=(c\text{Max},c\text{Min})$$

$$\text{When } m3-s\cdot c\text{Max}<c\text{Min},(c1,c2)=(c\text{Min},c\text{Max}) \quad \text{(Eq. 45)}$$

IX. Case in which the distribution of error d is handed as an elliptic paraboloid and the minimum value on the elliptic paraboloid is present within the code book range:

The method of calculating an optimum solution that is described below is applicable to a case in which the distribution of error d is handed as an elliptic paraboloid and the minimum value on the elliptic paraboloid is present within the code book range. When the minimum value is present within the code book range, an optimum solution may be calculated according to the equations in Eq. 31 above.

X. Case in which the distribution of error d is handed as an elliptic paraboloid and the minimum value on the elliptic paraboloid is present outside the code book range:

The method of calculating an optimum solution that is described below is applicable to a case in which the distribution of error d is handed as an elliptic paraboloid and the minimum value on the elliptic paraboloid is present outside the code book range. When the minimum value is present outside the code book range, it is desirable to obtain an optimum solution that becomes a point at which error is minimized within the code book range. In the case of an elliptic paraboloid, since error is increased along the ellipse from the point at which error is minimized, as illustrated in FIG. 7, error d is minimized at a point at which the elliptic paraboloid first comes into contact with the code book range on the contour line. The point at which error is minimized, which has been obtained according to the equations in Eq. 31, is assumed to meet the condition that (c1, c2) equals (m1, m2). In this case, if m1 is equal to or greater than cMax as in FIG. 9A, an optimum solution may be obtained by replacing c1 with cMax in the equation in Eq. 11 above. Since c1 is a fixed value, the equation is rewritten as the equation below, which is a quadratic function in which c2 is a variable. An optimum solution in the code book range may be obtained by the multiple root of the equation.

$$f(R_0,R_0)\cdot c2^2+\{2f(L_0,R_0)\cdot c\text{Max}-2f(R_0,C_0)\}\cdot c2+$$

$$f(L_0,L_0)\cdot c\text{Max}^2-2f(L_0,C_0)\cdot c\text{Max}+f(C_0,C_0)-d=2 \quad \text{(Eq. 46)}$$

In the above embodiment, when the straight line that meets the minimum value on a parabolic cylindrical surface or the minimum value on an elliptic paraboloid is present outside the code book range, the calculating unit 16 in the channel prediction coefficient coder 14 calculates an intersection between an boundary of the code book range and the parabolic cylindrical surface or elliptic paraboloid, that is, an optimum solution. When it is more important to shorten processing time than to improve sound quality, however, an arbitrary coefficient on a boundary, of the code book range, that is in the vicinity of the minimum value may be selected without calculating an optimum solution.

When the distribution of error d is handed as an elliptic paraboloid and the straight line that meets the minimum value on the elliptic paraboloid is present within the code book range, a plurality of optimum values are present. Even if any optimum solution is selected, error in predictive coding is the same. However, the number of bits used to code a channel prediction coefficient may vary depending on the optimum solution. FIG. 10 is a conceptual diagram illustrating the band of a channel prediction coefficient for each combination of time and a frequency band. The methods of coding a channel prediction coefficient are classified into two types; a coded value itself is sent and a difference is sent. The methods of sending a difference is further classified into two types; a difference from the coded value in an immediately preceding time is sent and a difference from the coded value in a one-level-lower frequency band is sent. If, for example, the method in which a difference from the coded value in an immediately preceding time is sent is selected to code c1(5) in FIG. 10, a difference obtained by subtracting c1(2) from c1(5) is coded instead of coding c1(5). If the method in which a difference from the coded value in a one-level-lower frequency band is sent is selected, a difference obtained by subtracting c1(4) from c1(5) is coded instead of coding c1(5).

When c1(5) in FIG. 10 is coded, there may be a plurality of solutions. If a solution by which either a difference between c1(5) and c1(2), which is a difference from the coded value in the immediately preceding time, or a difference between c1(5) and c1(4), which is a difference from the coded value in the one-level-lower frequency band, is minimized is selected from all solutions, the number of bits used to code channel prediction coefficient c1(5) is lessened. If the number of bits used by the channel prediction coefficient is lessened, the number of bits used in the MPS data illustrated in FIG. 5 is lessened and more bits may be thereby used in the AAC data and SBR data accordingly, enabling sound quality to be improved.

Finally, the calculating unit 16 in the channel prediction coefficient coder 14 uses optimum solutions, that is, channel prediction coefficients c1(k) and c2(k) included in the code book to reference a quantization table that indicates correspondence between index values and typical values, included in the channel prediction coefficient coder 14, of channel prediction coefficients c1(k) and c2(k). With reference to the quantization table, the channel prediction coefficient coder 14 determines the index values that are closest to channel prediction coefficients c1 and c2 for each frequency band. The channel prediction coefficient coder 14 obtains inter-index differences in the frequency direction for each frequency band. If, for example, the index value in frequency band k is 2 and the index value in frequency band (k−1) is 4, then the channel prediction coefficient coder 14 takes −2 as the inter-index value in frequency band k.

The calculating unit 16 in the channel prediction coefficient coder 14 references a coding table that indicates correspondence between inter-index differences and channel prediction coefficient codes, and determines channel prediction coefficient code $idxc_m(k)$ (m=1, 2) corresponding to a difference in each frequency band k of channel prediction coefficients $c_m(k)$ (m=1, 2). As with the similarity code, the channel prediction coefficient code may be, for example, a Huffman code, an arithmetic code, or another variable-length code that is more prolonged as the frequency at which the difference appears becomes higher. The quantization table and coding table are prestored in the memory provided in the channel prediction coefficient coder 14 or another place.

FIG. 11 illustrates an example of the quantization table of channel prediction coefficients. In the quantization table 1100 in FIG. 11, the cells in rows 1110, 1120, 1130, 1140, and 1150 each indicate an index value. The cells in rows 1115, 1125, 1135, 1145, and 1155 each indicate the typical value of the channel prediction coefficient corresponding to the index value indicated in the cell in row 1110, 1120, 1130, 1140, or 1150 in the same column. If, for example, channel prediction coefficient c1(k) in frequency band k is 1.21, an index value of 12 is closest to channel prediction coefficient c1(k) in the quantization table 1100. The channel prediction coefficient coder 14 then sets the index value for channel prediction coefficient c1(k) to 12.

FIG. 12 is an operation flowchart in audio coding processing. The flowchart in FIG. 12 indicates processing to be carried out on a multi-channel audio signal for one frame. While continuously receiving multi-channel audio signals, the audio coding device 1 *a* executes the procedure for the audio coding processing in FIG. 12 once for each frame.

The time-frequency converter 11 converts a channel-specific signal to a frequency signal (step S1201) and outputs the converted channel-specific frequency signal to the first down-mixing unit 12.

The first down-mixing unit 12 down-mixes the frequency signals in all channels to create frequency signals in three channels, which are the right channel, left channel and central channel, and calculates spatial information about the right channel, left channel, and central channel (step S1202). The first down-mixing unit 12 outputs the three-channel frequency signals to the second down-mixing unit 13 and channel prediction coefficient coder 14.

The second down-mixing unit 13 down-mixes the three-channel frequency signals to create a stereo frequency signal and outputs the created stereo frequency signal to the channel signal coder 17 (step S1203).

The channel prediction coefficient coder 14 determines a quadratic surface to be handled as the shape of the error distribution according to frequency signals $L_0(k, n)$, $R_0(k, n)$ and $C_0(k, n)$ and the result of the determination equation in Eq. 16 (step S1204).

The channel prediction coefficient coder 14 then follows the flowchart, described later, in FIG. 13 to calculate a channel prediction coefficient included in the code book according to the minimum value of error defined from the determined quadratic surface and to the code book range, and codes the calculated channel prediction coefficient (step S1205). The channel prediction coefficient coder 14 outputs the coded channel prediction coefficient to the spatial information coder 21.

The spatial information coder 21 uses the coded channel prediction coefficient received from the channel prediction coefficient coder 14 and spatial information to be coded to create an MPS code (step S1206). The spatial information coder 21 then outputs the MPS code to the multiplexer 22.

The channel signal coder 17 performs SBR coding on the high-frequency components of the received channel-specific stereo frequency signal. The channel signal coder 17 also performs AAC coding on low-frequency components, which have not been subject to SBR coding, (step S1207). The channel signal coder 17 then outputs, to the multiplexer 22, the AAC code and the SBR code such as information that represents positional relationships between low-frequency components used for replication and their corresponding high frequency components.

Finally, the multiplexer 22 multiplexes the created SBR code, AAC code, and MPS code to create a coded audio signal (step S1208), after which the multiplexer 22 outputs the coded audio signal. The audio coding device 1 terminates the coding processing.

The audio coding device 1 may execute processing in step S1206 and processing in step S1207 concurrently. Alternatively, the audio coding device 1 may execute processing in step S1208 before executing processing in step S1207.

FIG. 13 is an operation flowchart in channel prediction coefficient selection processing. The channel prediction coefficient coder 14 decides whether the quadratic surface determined in step S1204 in FIG. 12 is a parabolic cylindrical surface or an elliptic paraboloid (step S1301).

If the determined quadratic surface is a parabolic cylindrical surface (the result in step S1301 is Yes), the channel prediction coefficient coder 14 calculates the inclination of a straight line that meets the minimum value of error in the c1-c2 plane of channel prediction coefficients, according to real parts $Re\{l_0(k, n)\}$ and $Re\{r_0(k, n)\}$ of the frequency signal and its imaginary parts $Im\{l_0(k, n)\}$ and $Im\{r_0(k, n)\}$ and to the results of the determination equations in Eq. 32 (step S1302).

The channel prediction coefficient coder 14 then determines whether the minimum value of error is present within the code book range according to the inclination of the straight line and to the results of determination equations in Eq. 33, Eq. 34, Eq. 35, or Eq. 36, which are applied to the parabolic cylindrical surface. If the determined quadratic curve is an elliptic paraboloid (the result in step S1301 is No), the channel prediction coefficient coder 14 determines whether the minimum value of error is present within the code book range according to the results of the determination equations in Eq. 37, which are applied to the elliptic paraboloid (step S1303).

The channel prediction coefficient coder 14 then determines whether the minimum value of error is present within the code book range (step S1304). If the minimum value of error is present within the code book range (the result in step S1304 is Yes), the channel prediction coefficient coder 14 calculates an optimum solution, that is, a channel prediction coefficient included in the code book, according to the inclination of the straight line that meets the minimum value of error and to the arithmetic equations in Eq. 38, Eq. 40, Eq. 42, or Eq. 44, which are applied to the parabolic cylindrical surface or the arithmetic equations in Eq. 31, which are applied to the elliptic paraboloid (step S1305).

If the minimum value of error is present outside the code book range (the result in step S1306 is No), the channel prediction coefficient coder 14 calculates an optimum solution, that is, a channel prediction coefficient included in the code book, according to the inclination of the straight line that meets the minimum value of error and to the arithmetic equations in Eq. 39, Eq. 41, Eq. 43, or Eq. 45, which are applied to the parabolic cylindrical surface or the arithmetic equation in Eq. 46, which is applied to the elliptic paraboloid (step S1306).

Finally, the channel prediction coefficient coder 14 codes the channel prediction coefficient according to the optimum solution (step S1307).

FIG. 14A is a spectral diagram of the original sound of a multi-channel audio signal. FIG. 14B is a comparative example of a spectral diagram of an audio signal obtained by searching for all channel prediction coefficients included in the code book, followed by coding and decoding. FIG. 14C is a spectra diagram of an audio signal obtained by using the channel prediction coefficient selection method in the present disclosure to code a channel prediction coefficient and then decoding the coded channel prediction coefficient. The vertical axis of the spectral diagrams in FIGS. 14A to 14C indicates frequency and the horizontal axis indicates sampling time.

In FIG. 14B, all channel prediction coefficients included in the code book have been searched for and the channel prediction coefficient that results in the smallest error has been selected, so the spectrum in FIG. 14B is almost the same as the spectrum in FIG. 14A. A ratio of processing time taken in actual measurement in coding in FIG. 14B is assumed to be 1. The spectrum illustrated in FIG. 14C, which has been obtained by using the channel prediction coefficient selection method in the present disclosure, is also almost the same as the spectrum in FIG. 14A; deterioration in sound quality has not been confirmed. A ratio of processing time taken in actual measurement in coding in FIG. 14C is 1/471, indicating that the amount of processing was substantially reduced without sound quality being sacrificed.

According to still another embodiment, the channel signal coder 17 in the audio coding device 1 may use another coding method to code stereo frequency signals. For example, the channel signal coder 17 may use the AAC coding method to code a whole frequency signal. In this case, the SBR coder 18, illustrated in FIG. 1, is removed from the audio coding device 1.

Multi-channel audio signals to be coded are not limited to 5.1-channel audio signals. For example, audio signals to be coded may be audio signals having a plurality of channels such as 3-channel, 3.1-channel, and 7.1-channel audio signals. Even when an audio signal other than a 5.1-channel audio signal is to be coded, the audio coding device 1 calculates a channel-specific frequency signal by performing time-frequency conversion on a channel-specific audio signal. The audio coding device 1 then down mixes the frequency signals in all channels and creates a frequency signal having less channels than the original audio signal.

A computer program that causes a computer to execute the functions of the units in the audio coding device 1 in each of the above embodiments may be provided by being stored in a semiconductor memory, a magnetic recording medium, an optical recording medium, or another type of recording medium.

The audio coding device 1 in each of the above embodiments may be mounted in a computer, a video signal recording device, an image transmitting device, or any of other various types of devices that are used to transmit or record audio signals.

FIG. 15 is a functional block diagram of an audio coding device according to another embodiment. As illustrated in FIG. 15, the audio coding device 1 includes a controller 901, a main storage unit 902, an auxiliary storage unit 903, a drive unit 904, a network interface 906, an input unit 907, and a display unit 908. These units are mutually connected through a bus so that data may be transmitted and received.

The controller 901 is a central processing unit (CPU) that controls individual units and calculates or processes data in the computer. The controller 901 also functions as a calculating unit that executes programs stored in the main storage unit 902 and auxiliary storage unit 903; the controller 901 receives data from input unit 907, main storage unit 902, or auxiliary storage unit 903, calculates or processes the received data, and outputs the processed data to the display unit 908, main storage unit 902, or auxiliary storage unit 903.

The main storage unit 902 is a read-only memory (ROM) or a random-access memory (RAM); it stores or temporarily stores data and programs such as an operating system (OS), which is a basic software executed by the controller 901, application software.

The auxiliary storage unit 903 is a hard disk drive (HDD) or the like; it stores data related to application software or the like.

The drive unit 904 reads out a program from a storage medium 105 such as, for example, a flexible disk and installs the read-out program in the auxiliary storage unit 903.

A given program is stored on a recording medium 905. The given program stored on the recording medium 905 is installed in the audio coding device 1 via the drive unit 904. The given program, which has been installed, becomes executable by the audio coding device 1.

The network interface 906 is an interface between the audio coding device 1 and a peripheral unit having a communication function, the peripheral unit being connected to the network interface 906 through a local area network (LAN), a wide area network (WAN), or another network implemented by data transmission paths such as wired lines or wireless paths.

The input unit 907 has a keyboard that includes a cursor key, numeric keys, various types of functional keys, and the like and also has a mouse and slide pad that are used to, for example, select keys on the display screen of the display unit 908. The input unit 907 is a user interface used by the user to send manipulation commands to the controller 901 and enter data.

The display unit 908, which is formed with a cathode ray tube (CRT), a liquid crystal display (LCD) or the like, provides a display according to display data supplied from the controller 901.

The audio processing described above may be implemented by a program executed by a computer. When the program installed from a server or the like and is executed by the computer, the audio coding processing described above may be implemented.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio coding device that uses a first-channel signal, a second-channel signal, and a plurality of channel prediction coefficients included in a code book, according to which predictive coding is performed on a third-channel signal, the first-channel signal, the second-channel signal, and the third-channel signal being included in a plurality of channels of an audio signal, the device comprising:

a processor; and a memory which stores a plurality of instructions, which when executed by the processor, cause the processor to execute, determining a distribution of error defined by a difference between the third-channel signal before predictive coding and the third-channel signal after predictive coding as a given curved surface according to the first-channel signal, the second-channel signal, and the third-channel signal before predictive coding; and calculating channel prediction coefficients, included in the code book, that correspond to the first channel and the second channel from the code book, according to a minimum value of the error, the minimum value being defined by the given curved surface, and to a code book range defined by a minimum channel prediction coefficient and a maximum channel prediction coefficient among the plurality of channel prediction coefficients.

2. The device according to claim 1, wherein:

the given curved surface is a parabolic cylindrical surface or an elliptic paraboloid; and the determining is to determine the distribution of the error as a parabolic cylindrical surface or an elliptic paraboloid according to the first-channel signal, the second-channel signal, and the third-channel signal before predictive coding.

3. The device according to claim 1, wherein:

the calculating is to determine whether the minimum value is present within the code book range defined by the minimum channel prediction coefficient and the maximum channel prediction coefficient among the plurality of channel prediction coefficients; and if the minimum value is present within the code book range, the calculating is to calculate channel prediction coefficients, corresponding to the first channel and the second channel and included in the code book, that each minimize a difference from the minimum value.

4. The device according to claim 1, wherein:

the calculating is to determine whether the minimum value is present within the code book range defined by the minimum channel prediction coefficient and the maximum channel prediction coefficient among the plurality of channel prediction coefficients; and if the minimum value is present outside the code book range, the calculating is to calculate an intersection between an boundary of the code book range and the given curved surface and calculate channel prediction coefficients, corresponding to the first channel and the second channel and included in the code book, that each minimize a difference from the intersection.

5. The device according to claim 1, wherein if a plurality of channel prediction coefficients, corresponding to the first channel or the second channel, that each minimize the difference from the minimum value are included in the code book, the calculating is to select a channel prediction coefficient that minimizes an amount of time difference coding or frequency difference coding;

a determining unit that determines a distribution of error defined by a difference between the third-channel signal before predictive coding and the third-channel signal after predictive coding as a given curved surface according to the first-channel signal, the second-channel signal, and the third-channel signal before predictive coding; and a calculating unit that calculates channel prediction coefficients, included in the code book, that correspond to the first channel and the second channel from the code book, according to a minimum value of the error, the minimum value being defined by the given curved surface, and to a code book range defined by a minimum channel prediction coefficient and a maximum channel prediction coefficient among the plurality of channel prediction coefficients.

6. An audio coding method in which a first-channel signal, a second-channel signal, and a plurality of channel prediction coefficients included in a code book are used, according to which predictive coding is performed on a third-channel signal, the first-channel signal, the second-channel signal, and the third-channel signal being included in a plurality of channels of an audio signal, the method comprising:

determining a distribution of error defined by a difference between the third-channel signal before predictive coding and the third-channel signal after predictive coding as a given curved surface according to the first-channel signal, the second-channel signal, and the third-channel signal before predictive coding; and calculating, by a computer processor, channel prediction coefficients, included in the code book, that correspond to the first channel and the second channel from the code book, according to a minimum value of the error, the minimum value being defined by the given curved surface, and to a code book range defined by a minimum channel prediction coefficient and a maximum channel prediction coefficient among the plurality of channel prediction coefficients.

7. The method according to claim 6, wherein:

the given curved surface is a parabolic cylindrical surface or an elliptic paraboloid; and the determining is to determine the distribution of the error as a parabolic cylindrical surface or an elliptic paraboloid according to the first-channel signal, the second-channel signal, and the third-channel signal before predictive coding.

8. The method according to claim 6, wherein:

the calculating is to determine whether the minimum value is present within the code book range defined by the minimum channel prediction coefficient and the maximum channel prediction coefficient among the plurality of channel prediction coefficients; and if the minimum value is present within the code book range, the calculating is to calculate channel prediction coefficients, corresponding to the first channel and the second channel and included in the code book, that each minimize a difference from the minimum value.

9. The method according to claim 6, wherein:

the calculating is to determine whether the minimum value is present within the code book range defined by the minimum channel prediction coefficient and the maximum channel prediction coefficient among the plurality of channel prediction coefficients; and if the minimum value is present outside the code book range, the calculating is to calculate an intersection between an boundary of the code book range and the given curved surface and calculate channel prediction coefficients, corresponding to the first channel and the second channel and included in the code book, that each minimize a difference from the intersection.

10. The method according to claim 6, wherein if a plurality of channel prediction coefficients, corresponding to the first channel or the second channel, that each minimize the difference from the minimum value are included in the code book, the calculating is to select a channel prediction coefficient that minimizes an amount of time difference coding or frequency difference coding.

11. A non-transitory computer-readable storage medium that stores a computer program used in audio coding in which a first-channel signal, a second-channel signal, and a plurality of channel prediction coefficients included in a code book are used, according to which predictive coding is performed on a third-channel signal, the first-channel signal, the second-channel signal, and the third-channel signal being included in a plurality of channels of an audio signal, the program causing a computer to execute a process including determining a distribution of error defined by a difference between the third-channel signal before predictive coding and the third-channel signal after predictive coding as a given curved surface according to the first-channel signal, the second-channel signal, and the third-channel signal before predictive coding, and calculating channel prediction coefficients, included in the code book, that correspond to the first channel and the second channel from the code book, according to a minimum value of the error, the minimum value being defined by the given curved surface, and to a code book range defined by a minimum channel prediction coefficient and a maximum channel prediction coefficient among the plurality of channel prediction coefficients.

12. The non-transitory computer-readable storage medium according to claim 11, wherein:

the given curved surface is a parabolic cylindrical surface or an elliptic paraboloid; and the determining is to determine the distribution of the error as a parabolic cylindrical surface or an elliptic paraboloid according to the first-channel signal, the second-channel signal, and the third-channel signal before predictive coding.

13. The non-transitory computer-readable storage medium according to claim 11, wherein:

the calculating is to determine whether the minimum value is present within the code book range defined by the minimum channel prediction coefficient and the maximum channel prediction coefficient among the plurality of channel prediction coefficients; and if the minimum value is present within the code book range, the calculating is to calculate channel prediction coefficients, corresponding to the first channel and the second channel and included in the code book, that each minimize a difference from the minimum value.

14. The non-transitory computer-readable storage medium according to claim 11, wherein:

the calculating is to determine whether the minimum value is present within the code book range defined by the minimum channel prediction coefficient and the maximum channel prediction coefficient among the plurality of channel prediction coefficients; and if the minimum value is present outside the code book range, the calculating is to calculate an intersection between an boundary of the code book range and the given curved surface and calculate channel prediction coefficients, corresponding to the first channel and the second channel and included in the code book, that each minimize a difference from the intersection.

15. The non-transitory computer-readable storage medium according to claim 11, wherein if a plurality of channel prediction coefficients, corresponding to the first channel or the second channel, that each minimize the difference from the minimum value are included in the code book, the calculating is to select a channel prediction coefficient that minimizes an amount of time difference coding or frequency difference coding.

* * * * *